US011772393B2

(12) United States Patent
Nonaka

(10) Patent No.: US 11,772,393 B2
(45) Date of Patent: Oct. 3, 2023

(54) PRINTER AND CUTTING DEVICE WITH ACTUATED PINCH ROLLERS

(71) Applicant: Roland DG Corporation, Hamamatsu (JP)

(72) Inventor: Ryosuke Nonaka, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 17/563,182

(22) Filed: Dec. 28, 2021

(65) Prior Publication Data

US 2022/0242150 A1 Aug. 4, 2022

(30) Foreign Application Priority Data

Feb. 2, 2021 (JP) ..... 2021-015073

(51) Int. Cl.

| | |
|---|---|
| ***B41J 13/02*** | (2006.01) |
| ***B41J 13/048*** | (2006.01) |
| ***B41J 13/03*** | (2006.01) |
| ***B41J 11/70*** | (2006.01) |
| ***B41J 11/00*** | (2006.01) |

(52) U.S. Cl.

CPC ..... *B41J 13/025* (2013.01); *B41J 11/0045* (2013.01); *B41J 11/70* (2013.01); *B41J 11/703* (2013.01); *B41J 11/706* (2013.01); *B41J 13/03* (2013.01); *B41J 13/048* (2013.01)

(58) Field of Classification Search

CPC ..... B41J 13/025; B41J 11/0045; B41J 11/70; B41J 11/703; B41J 11/706; B41J 13/03; B41J 13/048

See application file for complete search history.

(56) References Cited

U.S. PATENT DOCUMENTS

| | | | | |
|---|---|---|---|---|
| 2008/0240834 | A1 | 10/2008 | Takada et al. | |
| 2010/0025917 | A1* | 2/2010 | Yamaguchi | B65H 5/062 271/10.13 |
| 2015/0130123 | A1 | 5/2015 | Tamaki | |
| 2019/0111712 | A1* | 4/2019 | Nonaka | B41J 29/02 |

FOREIGN PATENT DOCUMENTS

| | | | | |
|---|---|---|---|---|
| JP | 2001-302013 | A | 10/2001 | |
| JP | 2008-238671 | A | 10/2008 | |
| JP | 2014-018892 | A | 2/2014 | |
| JP | 2014-108883 | A | 6/2014 | |
| KR | 20080042244 | A * | 4/2009 | B41J 11/005 |

* cited by examiner

*Primary Examiner* — Henok D Legesse
(74) *Attorney, Agent, or Firm* — KEATING & BENNETT, LLP

(57) ABSTRACT

A printer includes a driving roller to move a medium supported on a support table in a predetermined transportation direction, and pinch roller assemblies each including a pinch roller, a support to support the pinch roller to allow the pinch roller to contact, or to be spaced from, the driving roller, and an actuator provided upstream in the transportation direction with respect to the pinch roller. The actuator includes a contact portion contactable with the support, and an operation portion to press the contact portion to the support to move the pinch roller in a direction away from the driving roller.

14 Claims, 13 Drawing Sheets

PRINTER AND CUTTING DEVICE WITH ACTUATED PINCH ROLLERS

CROSS REFERENCE TO RELATED APPLICATION

This application claims the benefit of priority to Japanese Patent Application No. 2021-015073 filed on Feb. 2, 2021. The entire contents of this application are hereby incorporated by reference herein.

BACKGROUND OF THE INVENTION

1. Field of the Invention

The present invention relates to a printer and a cutting device.

2. Description of the Related Art

Conventionally, a printer or a cutting device including a transportation device transporting a medium has been known. A medium is a target of printing or cutting. The transportation device typically includes a driving roller embedded in a platen, and a pinch roller provided so as to face the driving roller and pressing the medium. For example, Japanese Laid-Open Patent Publication No. 2008-238671 discloses a printer/plotter including a printer head, a cutting head, a plurality of roller assemblies each including a pinch roller and a lever elevating the pinch roller up or down, and an arm operating the lever.

In the printer/plotter disclosed in Japanese Laid-Open Patent Publication No. 2008-238671, a slider including the arm is engaged with a guide rail, and the guide rail is engaged with the printer head and the cutting head. The arm is movable between an engaged position at which the arm is engaged with the lever and a retracted position at which the arm is not in contact with the lever. The lever swings horizontally to elevate the pinch roller up or down. It is described in Japanese Laid-Open Patent Publication No. 2008-238671 that in the printer/plotter disclosed therein, the position of the arm is switched between the engaged position and the retracted position based on a program and the slider is caused to run along the guide rail, and thus the lever of each of the plurality of roller assemblies may be operated automatically. It is also described that as a result of the above, the clamp state may be set or adjusted in detail with no need for a user to switch the levers in all the roller assemblies each time the adjustment or the like is necessary.

In the printer/plotter disclosed in Japanese Laid-Open Patent Publication No. 2008-238671, the pinch rollers are each elevated up or down automatically in accordance with the program. Therefore, during the execution of the program, it is impossible to perform an operation, not described in the program, of automatically elevating the pinch roller up or down. In actual printing, however, there may be a case where, for example, a part of the medium is floated unexpectedly and thus a part of the pinch rollers needs to be elevated up during printing.

In the case where the operation, not described in the program, of elevating the pinch roller up or down is needed during the execution of the program as described above, the printer/plotter disclosed in Japanese Laid-Open Patent Publication No. 2008-238671 allows the printing operation to be temporarily paused so that the user may operate the lever to elevate the pinch roller up or down. A temporary pause in the printing operation often causes a problem that the printing state is changed after the pause. A temporary pause in a cutting operation performed by a cutting device decrease at least the productivity of cutting. Even if the user wishes to operate the lever during the printing or the cutting in order to avoid such a problem, the printer/plotter disclosed in Japanese Laid-Open Patent Publication No. 2008-238671 does not basically permit such a work because the printer head and the cutting head run before the lever.

SUMMARY OF THE INVENTION

Preferred embodiments of the present invention provide printers and cutting devices each including a plurality of pinch rollers and allowing each of the plurality of pinch rollers to be elevated up or down at a desired timing.

A printer disclosed herein includes a support table to support a medium, a driving roller provided on the support table to move the medium supported on the support table in a predetermined transportation direction, a plurality of pinch roller assemblies facing the driving roller, and a print head provided downstream in the transportation direction with respect to the driving roller and the plurality of pinch roller assemblies and facing the support table. The plurality of pinch roller assemblies each include a pinch roller facing the driving roller, a support to support the pinch roller to allow the pinch roller to contact, or to be spaced from, the driving roller, and an actuator provided upstream in the transportation direction with respect to the pinch roller. The actuator includes a contact portion contactable with the support, and an operation portion to press the contact portion to the support to move the pinch roller in a direction away from the driving roller.

A cutting device disclosed herein includes a support table to support a medium; a driving roller provided on the support table and to move the medium supported on the support table in a predetermined transportation direction; a plurality of pinch roller assemblies facing the driving roller; and a cutting head provided downstream in the transportation direction with respect to the driving roller and the plurality of pinch roller assemblies and facing the support table. The plurality of pinch roller assemblies each include a pinch roller facing the driving roller, a support to support the pinch roller to allow the pinch roller to contact, or to be spaced from, the driving roller, and an actuator provided upstream in the transportation direction with respect to the pinch roller. The actuator includes a contact portion contactable with the support, and an operation portion to press the contact portion to the support to move the pinch roller in a direction away from the driving roller.

According to the printer or the cutting device described above, each of the pinch roller units includes the actuator capable of separating the pinch roller from the driving roller. The actuator is provided upstream in the transportation direction with respect to the pinch roller. The print head and the cutting head are provided downstream in the transportation direction with respect to the pinch roller unit. Thus, the actuator is provided on the side opposite to the print head or the cutting head with respect to the pinch roller. With a printer or a cutting device having such a structure, the user may operate the actuator from the side opposite to the print head or the cutting head even while the print head or the cutting head is used during printing or cutting. Therefore, each of the pinch rollers may approach, or may be distanced from, the driving roller at a desired timing even during the printing or the cutting.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

[Structure of an Inkjet Printer with a Cutting Head]

Figure 1:
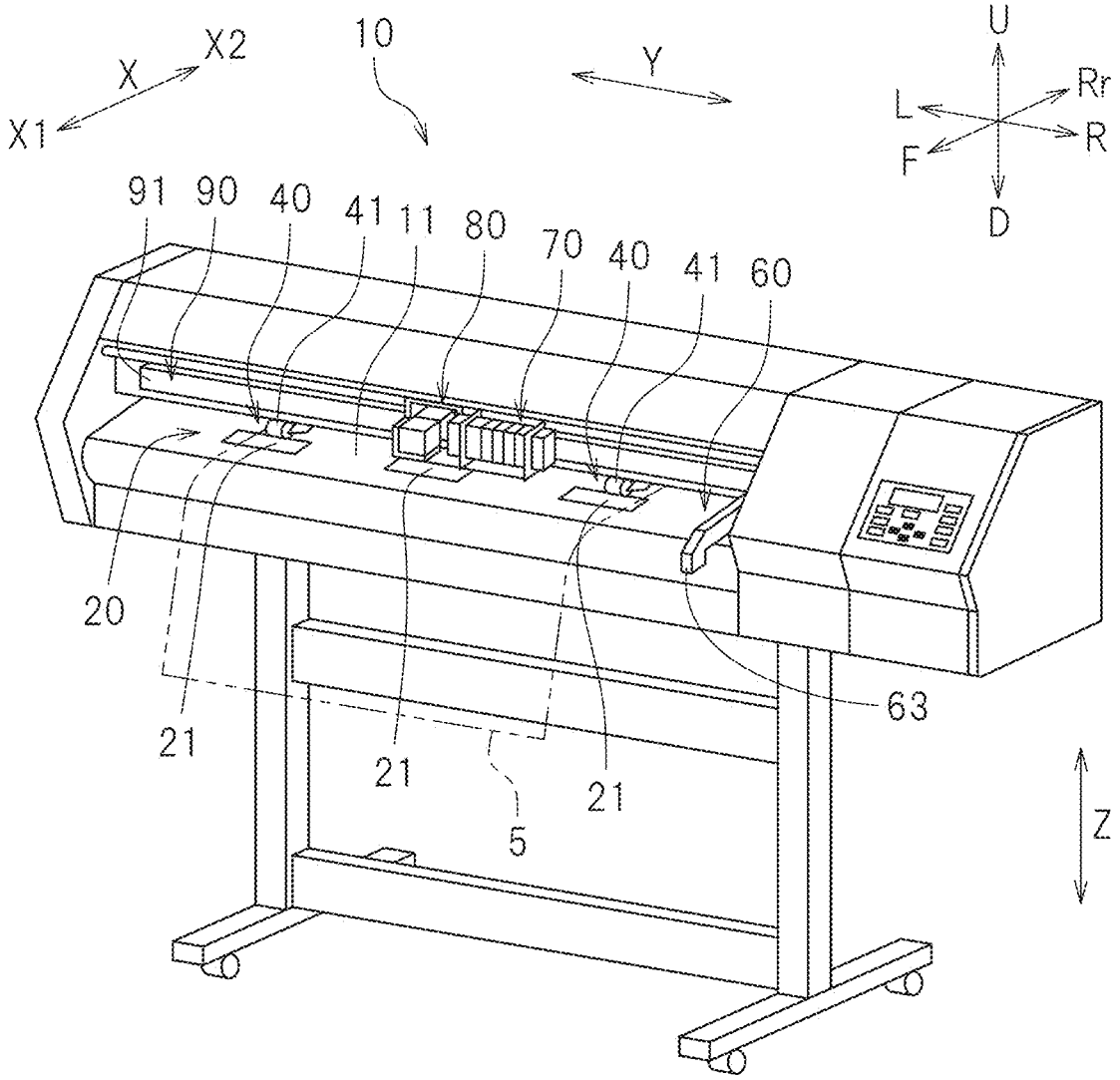
FIG. 1 is a perspective view of a printer with a cutting head according to a preferred embodiment of the present invention.

Hereinafter, one preferred embodiment of the present invention will be described with reference to the drawings. FIG. 1 is a perspective view of an inkjet printer 10 with a cutting head according to this preferred embodiment (hereinafter, the printer 10 with the cutting head will be referred to as the "printer 10"). As shown in FIG. 1, the printer 10 according to this preferred embodiment performs printing on, and cuts, a sheet-like medium 5. The medium 5 may be, for example, a sealing member including a base sheet and a release paper sheet stacked on the base sheet and coated with an adhesive, a recording paper sheet, a resin sheet or the like. There is no specific limitation on the type of the medium 5 as long as the medium 5 may be subjected to at least either printing or cutting and is transportable by a transportation device 20 described below.

The printer 10 includes a platen 11 supporting the medium 5, the transportation device 20 transporting the medium 5 supported by the platen 11 in a predetermined transportation direction, a print head 70 performing printing on the medium 5, a cutting head 80 cutting the medium 5, and a head moving device 90 moving the print head 70 and the cutting head 80.

Aa described below in detail, the print head 70 and the cutting head 80 are movable in a Y direction in the figures. The medium 5 is transported in an X direction in the figures. Hereinafter, the Y direction will also be referred to as a "main scanning direction", and the X direction will also be referred to as a "sub scanning direction". The main scanning direction Y corresponds to a width direction of the medium 5, and the sub scanning direction X corresponds to a longitudinal direction of the medium 5. In this preferred embodiment, the main scanning direction Y is a left-right direction. The sub scanning direction X is a front-rear direction. The main scanning direction Y, the sub scanning direction X and an up-down direction Z cross each other perpendicularly. The medium 5 is fed from a feed roll (not shown) provided in a rear portion of the printer 10, and is transported forward by the transportation device 20. Then, the medium 5 is taken up by a take-up roll (not shown) provided in a front portion of the printer 10. An X1 direction is a downstream direction in the sub scanning direction X, in which the medium 5 is transported. In this preferred embodiment, the X1 direction is a forward direction. An X2 direction is an upstream direction in the sub scanning direction X, in which the medium 5 is transported. In this preferred embodiment, the X2 direction is a rearward direction. In this specification, in the case where one component is provided downstream with respect to a different component, the one component may be expressed as being provided on the X1 side with respect to the different component. This is also applicable to "X2". These directions are provided for ease of description, and do not limit the manner of installation of the printer 10 in any way. In the figures, letters F, Rr, L, R, U and D respectively represent front, rear, left, right, up and down with respect to the printer 10.

As shown in FIG. 1, the transportation device 20 includes a plurality of grit rollers 21, a feed motor (not shown), and a plurality of pinch roller units 40. The plurality of grit rollers 21 are provided in the platen 11, and are driven by the feed motor to rotate in the sub scanning direction X. The plurality of pinch roller units 40 are provided above the platen 11. The plurality of pinch roller units 40 each include a pinch roller 41 allowed to contact, or to be separated from, the corresponding grit roller 21. The pinch roller 41 presses the medium 5 from above. In a state where the pinch rollers 41 are elevated down to contact the grit rollers 21 and the medium 5 is held between the pinch rollers 41 and the grit rollers 21, the grit rollers 21 are rotated. When this occurs, the medium 5 is transported downstream in the sub scanning direction X, namely, in the X1 direction, or upstream in the sub scanning direction X, namely, in the X2 direction.

In this preferred embodiment, the transportation device 20 includes an overall elevation mechanism 60 elevating all the pinch rollers 41 up or down at the same time. In this preferred embodiment, the pinch roller units 40 each include an actuator 45 (see FIG. 9) elevating the corresponding pinch roller 41 up or down independently, in addition to the overall elevation mechanism 60. A structure of the transportation device 20 will be described below in detail. The transportation device 20 includes a greater number of the grit rollers 21 and a greater number of the pinch roller units 40, which are mostly omitted in FIG. 1.

Figure 2:
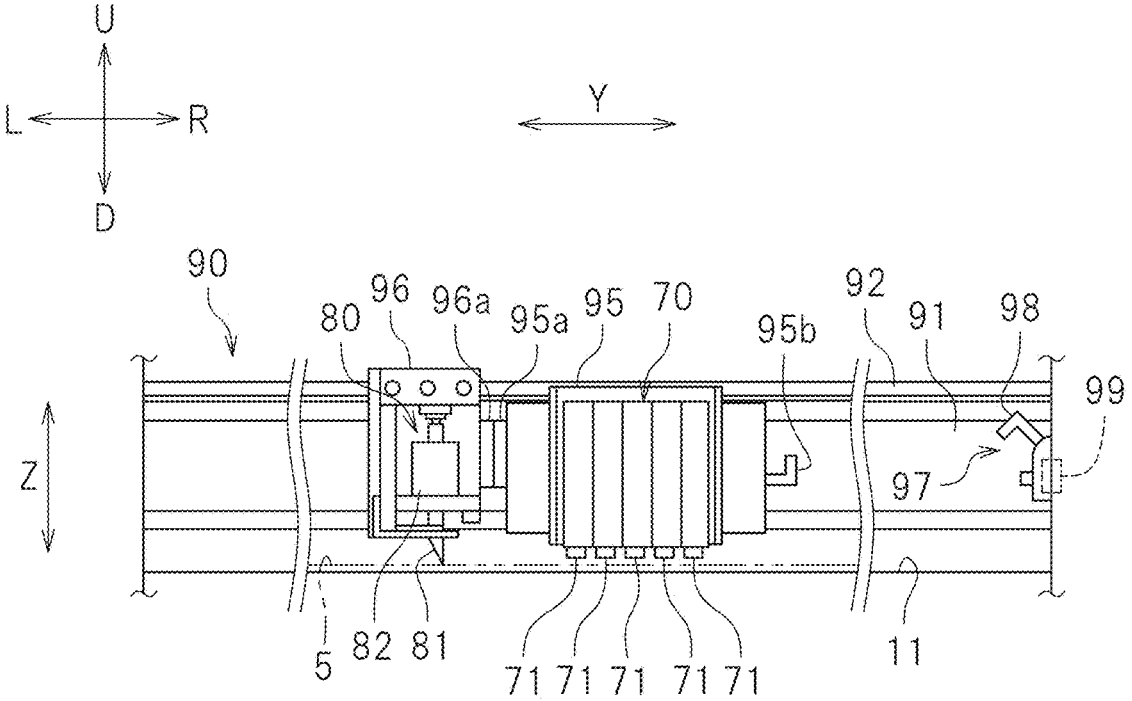
FIG. 2 is a front view of a print head and the cutting head in a state where a first carriage and a second carriage are coupled with each other.
Figure 3:
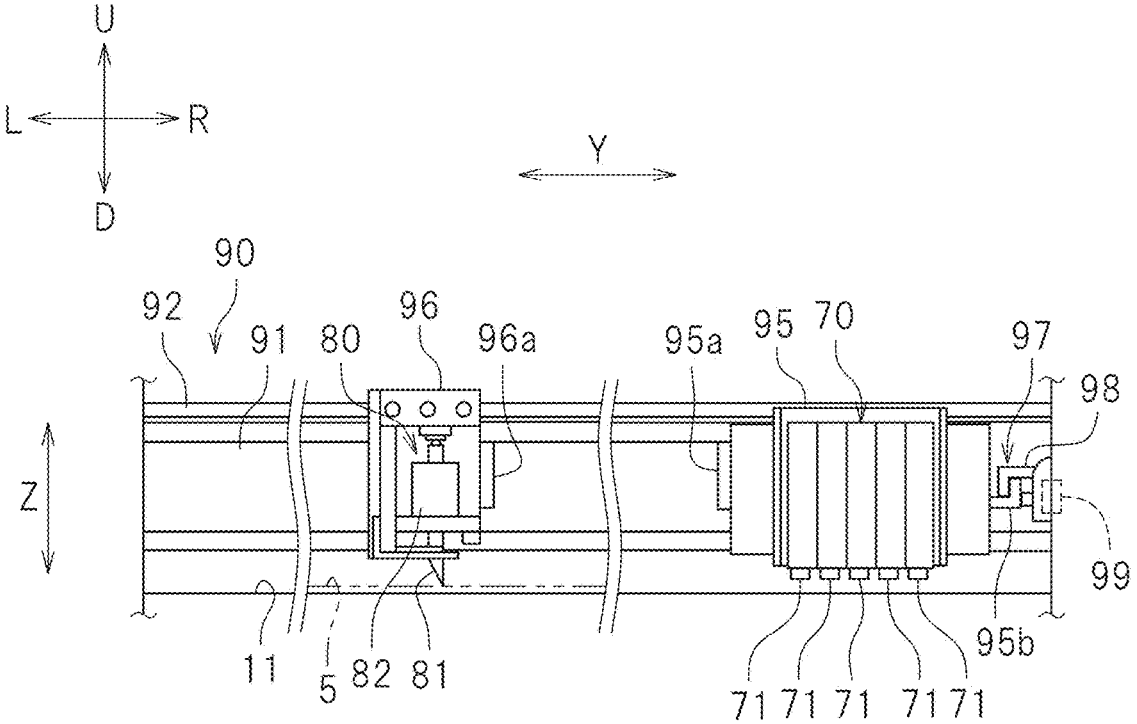
FIG. 3 is a front view of the print head and the cutting head in a state where the first carriage and the second carriage are separated from each other.

The head moving device 90 moves the print head 70 and the cutting head 80 in the main scanning direction Y. FIG. 2 and FIG. 3 are each a front view of the print head 70 and the cutting head 80. FIG. 2 shows a state where a first carriage 95, on which the print head 70 is mounted, and a second carriage 96, on which the cutting head 80 is mounted, are coupled with each other. FIG. 3 shows a state where the first carriage 95 and the second carriage 96 are separated from each other. In the state where the first carriage 95 and the second carriage 96 are coupled with each other, the head moving device 90 moves the first carriage 95 and the second carriage 96 integrally. In the state where the first carriage 95 and the second carriage 96 are separated from each other, the head moving device 90 moves only the second carriage 96 independently.

As shown in FIG. 2 and FIG. 3, the head moving device 90 includes a guide rail 91, a belt 92, and a scan motor (not shown). The guide rail 91 is provided above the platen 11. The guide rail 91 extends in the main scanning direction Y. The print head 70 and the cutting head 80 are in slidable engagement with the guide rail 91 respectively via the first carriage 95 and the second carriage 80. The belt 92 extends in the main scanning direction Y and is secured on a top rear portion of the second carriage 96. The belt 92 is connected with the scan motor. When the scan motor is rotated, the belt 92 runs in the main scanning direction Y. As a result, the second carriage 96 moves in the main scanning direction Y.

The first carriage 95 and the second carriage 96 are coupled with, or separated from, each other by a first coupling member 95*a* and a second coupling member 96*a*. As shown in FIG. 2 and FIG. 3, the first coupling member 95*a* is a component of the first carriage 95 and is provided in a left portion thereof. The second coupling member 96*a* is a component of the second carriage 96 and is provided in a right portion thereof. In this preferred embodiment, the first coupling member 95*a* and the second coupling member 96*a* use a magnetic force to couple the first carriage 95 and the second carriage 96 to each other. One of the first coupling member 95*a* and the second coupling member 96*a* includes a magnet, and the other of the first coupling member 95*a* and the second coupling member 96*a* includes a magnetic body attracted to the magnet. The coupling members 95*a* and 96*a* are not limited to using the magnetic force, and may include an engageable member or the like. The first carriage 95 and the second carriage 96 are coupled with each other by mutual contact of the first coupling member 95*a* and the second coupling member 96*a*.

An L-shaped receiving tool 95*b* is provided to the right of the first carriage 95. A lock device 97 securing the first carriage 95 is provided in the vicinity of a right end of the guide rail 91. The lock device 97 includes a hook 98 allowed to be hooked with the receiving tool 95*b*, and a locking solenoid 99 moving the hook 98 between a locked position (see FIG. 3) and an unlocked position (see FIG. 2).

When printing is to be performed with the print head 70, the hook 98 is set to the unlocked position as shown in FIG. 2. The second carriage 96 is moved rightward to put the first coupling member 95*a* and the second coupling member 96 into contact with each other. When this occurs, the second carriage 96 and the first carriage 95 are coupled with each other. As a result, the first carriage 95 becomes movable in the main scanning direction Y together with the second carriage 96. In the state where the first carriage 95 and the second carriage 96 are coupled with each other, the head moving device 90 moves the print head 70 and the cutting head 80 in the main scanning direction Y.

When cutting is to be performed with the cutting head 80, as shown in FIG. 3, the first carriage 95 is positioned at a wait position at a right end of a range in which the first carriage 95 is movable, and the hook 98 of the lock device 97 is set at the locked position. As a result, the first carriage 95 is inhibited from moving. When the second carriage 96 moves leftward in this state, the first coupling member 95*a* and the second coupling member 96*a* are separated from each other, and thus the first carriage 95 and the second carriage 96 are disengaged from each other. As a result, the second carriage 96 becomes movable in the main scanning direction Y whereas the first carriage 95 is in a wait state at the wait position.

The print head 70 is mounted on the first carriage 95. The print head 70 is provided so as to face the platen 11. The print head 70 is provided downstream in the sub scanning direction X, namely, on the X1 side, with respect to the grit rollers 21 and the pinch roller units 40. The print head 70 injects ink and performs printing on the medium 5. The print head 70 includes a plurality of ink heads 71. The plurality of ink heads 71 each have a plurality of nozzles (not shown) in a bottom surface thereof. Ink is injected through the nozzles. There is no specific limitation on the number of the ink heads 71. There is no specific limitation on the type or color of the ink injected by the ink heads 71.

The cutting head 80 is mounted on the second carriage 96. The cutting head 80 is also provided downstream in the sub scanning direction X, namely, on the X1 side, with respect to the grit rollers 21 and the pinch roller units 40. The cutting head 80 faces the platen 11. The cutting head 80 includes a cutter 81 and a solenoid 82. When the solenoid 82 is turned on or off, the cutter 81 is moved in the up-down direction Z to contact, or to be separated from, the medium 5. The cutter 81 contacts the medium 5 to cut the medium 5.

[Structure of the Transportation Device]

Figure 4:
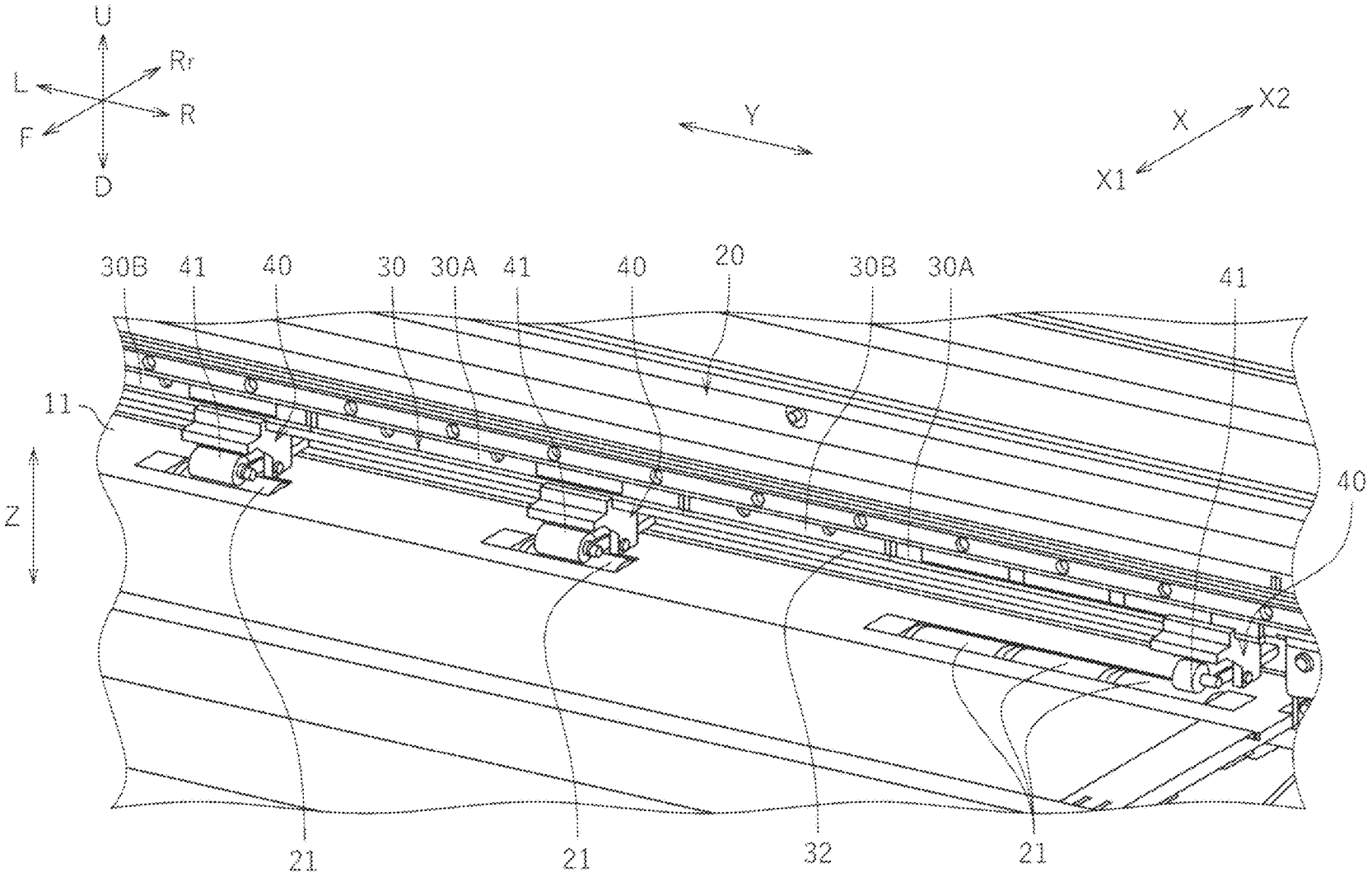
FIG. 4 is a perspective view of a part of the transportation device as seen from the front.
Figure 5:
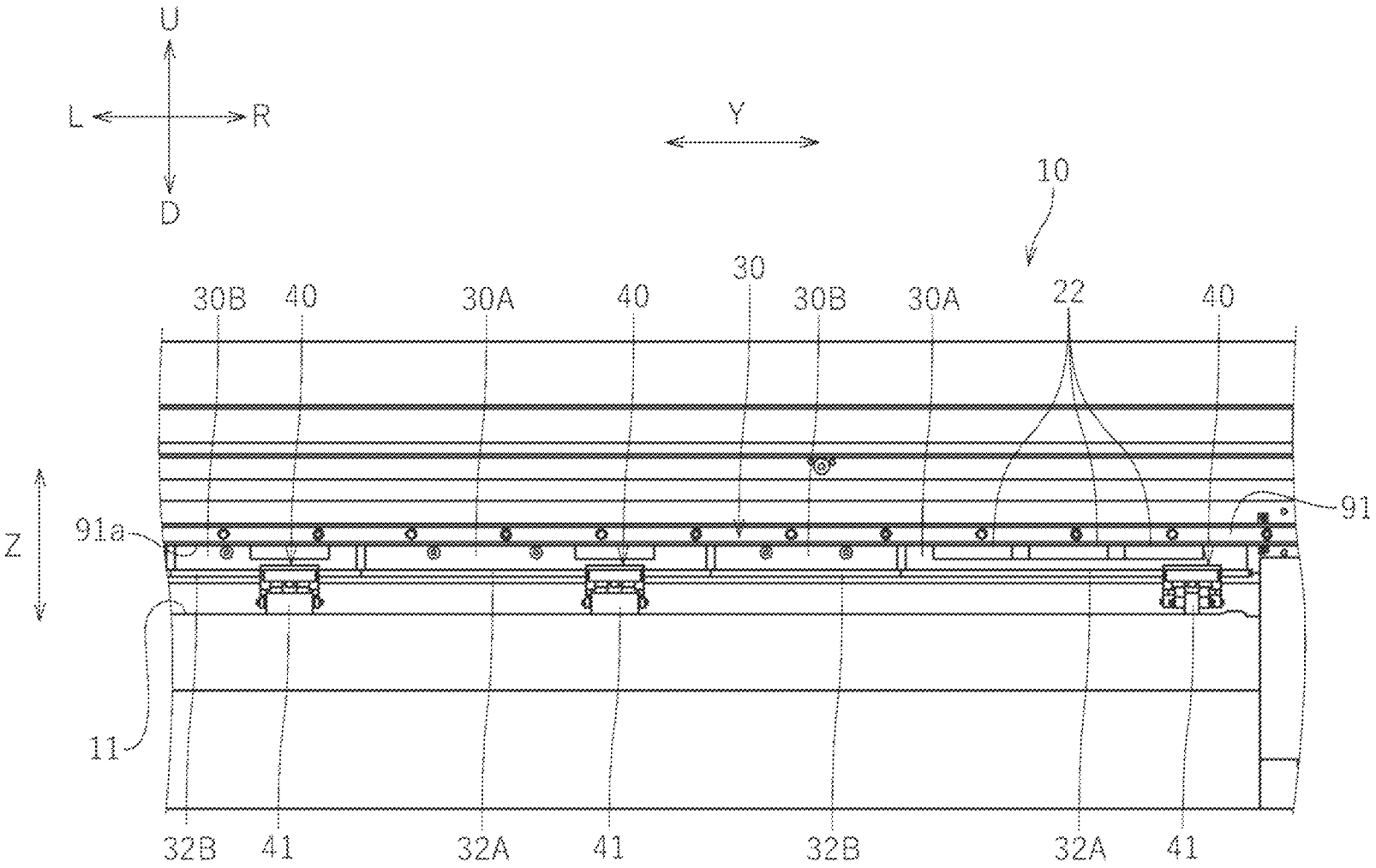
FIG. 5 is a front view of the printer.

Hereinafter, the structure of the transportation device will be described in detail. As described above, the transportation device 20 includes the plurality of grit rollers 21 rotatable in the sub scanning direction X and the plurality of pinch roller units 40 pressing the medium from above. FIG. 4 is a perspective view of a part of the transportation device 20 as seen from the front. FIG. 5 is a front view of the printer 10. As shown in FIG. 4, the plurality of grit rollers 21 are provided in a line in the main scanning direction Y. The grit rollers 21 each extend in the main scanning direction Y.

As shown in FIG. 4, the plurality of grit rollers 21 are each embedded in the platen 11 so as to be partially exposed. As described above, the grit rollers 21 are each connected with the feed motor (not shown) and driven by the feed motor to rotate in the sub scanning direction X. The grit rollers 21 each drive the medium 5 supported by the platen 11 to move the medium 5 downstream in the sub scanning direction X, namely, in the X1 direction, or upstream in the sub scanning direction X, namely, in the X2 direction, which is opposite to the X1 direction. As shown in FIG. 4, the rightmost grit roller 21 is longer than the other grit rollers 21 in the main scanning direction Y. A reason for this is that the position of the right end of the medium 5 is varied in accordance with the width of the medium 5. In this preferred embodiment, the plurality of grit rollers 21 are provided. Alternatively, one grit roller 21 long in the main scanning direction Y may be provided.

The plurality of pinch roller units 40 are provided so as to face the grit rollers 21. In this preferred embodiment, the plurality of pinch roller units 40 face the plurality of grit rollers 21 in a one-to-one relationship. Alternatively, in the case where, for example, one grit roller 21 is long in the main scanning direction Y, two or more pinch roller units 40 may face the one long grit roller 21. The position of each pinch roller unit 40 in the main scanning direction Y is changeable in accordance with the position of the corresponding grit roller 21 in the main scanning direction Y. The positions of the pinch roller units 40 in the main scanning direction Y except for the position of the rightmost pinch roller unit 40 are changed during the production of the printer 10, such that these pinch roller units 40 face the grit rollers 21 in a one-to-one relationship. With such an arrangement, as shown in FIG. 5, these pinch roller units 40 are located at predetermined positions in the main scanning direction Y. The position of the rightmost pinch roller unit 40 in the main scanning direction Y is changed by a user in accordance with the width of the medium 5.

In this preferred embodiment, the pinch roller units 40 at both of two ends in the main scanning direction Y press the medium 5 at a higher load than the other pinch roller units 40. If all the pinch roller units 40 press the medium 5 at an equivalent pressing force, in the case where the medium 5 is narrow, it is not specifically needed to move the rightmost pinch roller unit 40 (or a few pinch roller units 40 counted from the right end) in the main scanning direction Y to press the medium 5. In the printer 10 according to this preferred embodiment, the pinch roller units 40 at both of the two ends are assumed to press the medium 5 at a high load. Therefore, the rightmost pinch roller unit 40 needs to be moved in the main scanning direction Y in accordance with the width of the medium 5. As shown in FIG. 5, there are marks 22 on a front surface of the printer 10 to show the general positions at which the rightmost pinch roller unit 40 is to be located in accordance with the width of the medium 5.

As shown in FIG. 4, the transportation device 20 includes a pinch rail 30 engageable with the plurality of pinch roller units 40. The plurality of pinch roller units 40 are slidable in the main scanning direction Y along the pinch rail 30. As shown in FIG. 4, the pinch rail 30 is provided above the platen 11 so as to face the platen 11, and extends in the main scanning direction Y.

Figure 6:
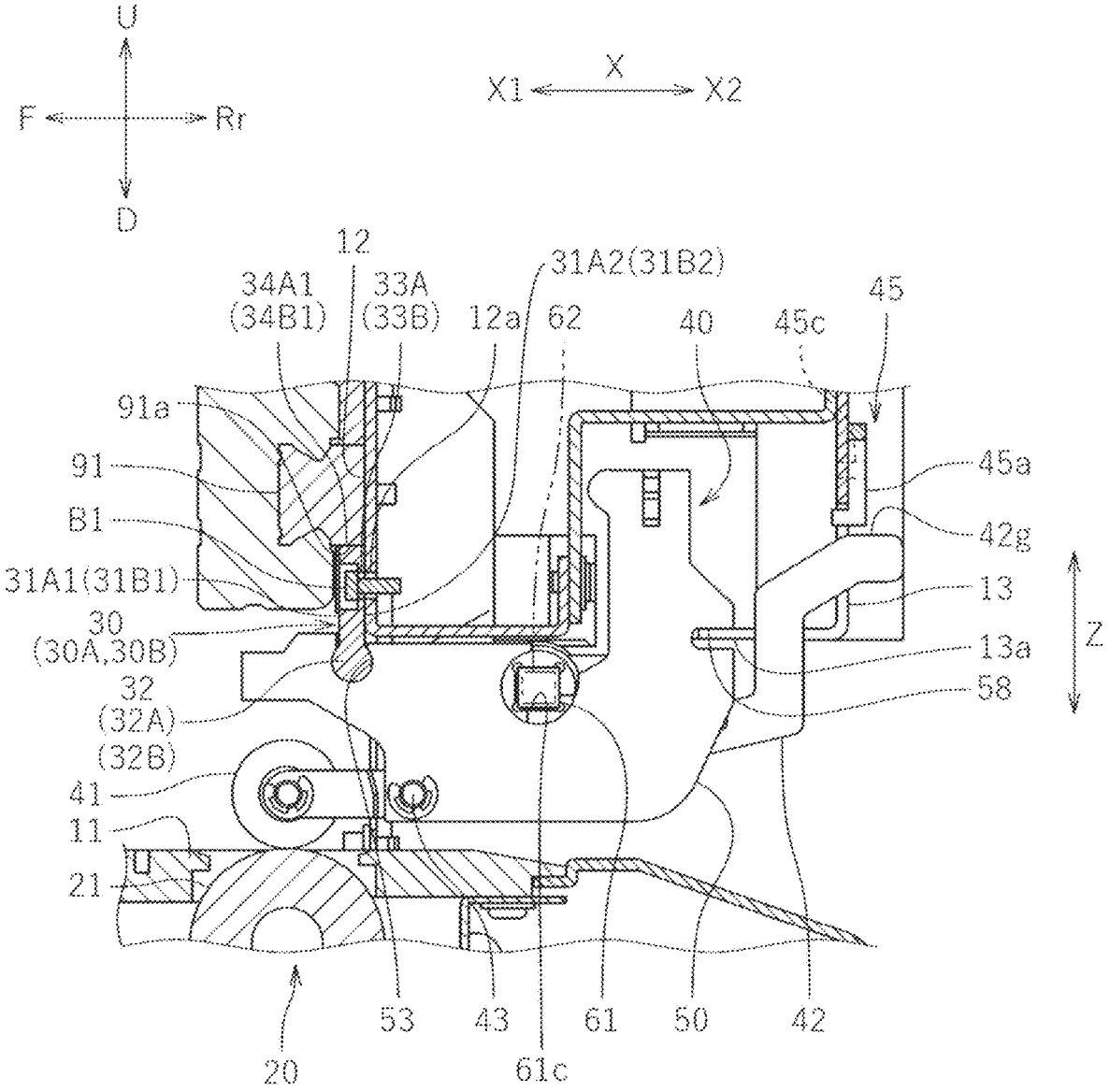
FIG. 6 is a cross-sectional view of a part of the transportation device taken along a plane extending in a sub scanning direction and an up-down direction.

FIG. 6 is a cross-sectional view of a part of the transportation device 20 taken along a plane extending in the sub scanning direction and the up-down direction Z. As shown in FIG. 5 and FIG. 6, the pinch rail 30 is a flat plate-like member extending in the main scanning direction Y and in the up-down direction Z. As shown in FIG. 5, in this preferred embodiment, the pinch rail 30 includes a plurality of first short rails 30A and a plurality of second short rails 30B located in a line in the main scanning direction Y. The pinch rail 30 is an assembly of the plurality of first short rails 30A and the plurality of second short rails 30B. As shown in FIG. 5, the plurality of first short rails 30A and the plurality of second short rails 30B are located alternately in the main scanning direction Y in this preferred embodiment. As shown in FIG. 6, the plurality of first short rails 30A and the plurality of second short rails 30B are abutted against a front panel 12 of the printer 10, and are tightened to the front panel 12 by bolts B1. The plurality of first short rails 30A and the plurality of second short rails 30B are attached on the front panel 12 independently. The position of the pinch rail 30 in the sub scanning direction X is determined by being abutted against the front panel 12. The front panel 12 is firm and is formed precisely so as to be preferable to allow the guide rail 91 to be secured thereto.

As shown in FIG. 6, the guide rail 91 is secured to the front panel 12. The guide rail 91 is provided above the pinch rail 30. The plurality of first short rails 30A and the plurality of second short rails 30B included in the pinch rail 30 are abutted against a surface of the guide rail 91 facing the platen 11, namely, against a bottom surface 91*a* of the guide rail 91 in this preferred embodiment. Hereinafter, a surface, of each of the plurality of first short rails 30A, that is abutted against the bottom surface 91*a* of the guide rail 91 will be referred to also as a positioning surface 34A1. A surface, of each of the plurality of second short rails 30B, that is attached to the bottom surface 91*a* of the guide rail 91 will be referred to also as a positioning surface 34B1. The position of the pinch rail 30 in the up-down direction Z is determined by the positioning surfaces 34A1 and 34B1 being abutted against the bottom surface 91*a* of the guide rail 91. The guide rail 91 has a high rigidity and a high size precision in order to allow the first carriage 95 and the second carriage 96 to slide smoothly. The guide rail 91 is positioned highly precisely with respect to the platen 11 in order to allow the print head 70 and the cutting head 80 to be away from the platen 11 by a predetermined distance. Therefore, the guide rail 91 is used to determine the position of the pinch rail 30 in the up-down direction Z.

As shown in FIG. 6, the pinch rail 30 includes an engaged portion 32 engageable with the pinch roller units 40. The engaged portion 32 is provided at a bottom end of the pinch rail 30. The engaged portion 32 of the pinch rail 30 as the assembly of the plurality of first short rails 30A and the plurality of second short rails 32B includes a plurality of engaged portions 32A of the plurality of first short rails 30A and a plurality of engaged portions 32B of the plurality of second short rails 30B located in a line in the main scanning direction Y. The pinch roller units 40 slide in the main scanning direction Y along the engaged portion 32 to move in the main scanning direction Y.

[Structure of the First Short Rails and the Second Short Rails]

Figure 7:
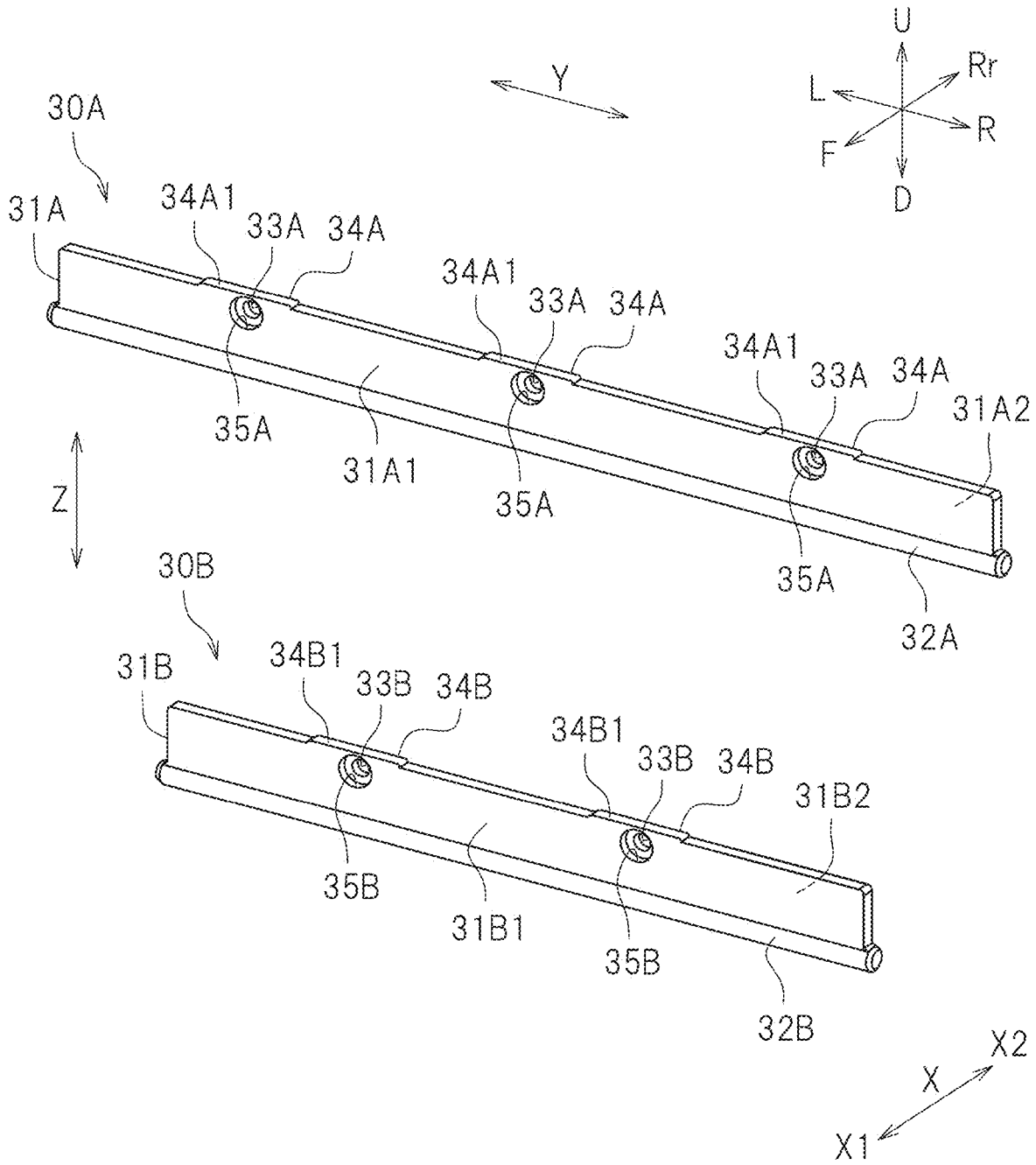
FIG. 7 is a perspective view of a first short rail and a second short rail.

FIG. 7 is a perspective view of one first short rail 30A and one second short rail 30B. The directions referred to in the following description of the first short rail 30A and the second short rail 30B are those in a state where the first short rail 30A and the second short rail 30B are attached to the printer 10. As shown in FIG. 7, the first short rail 30A and the second short rail 30B are each like a flat plate extending in the main scanning direction Y and in the up-down direction Z. In this preferred embodiment, the first short rail 30A and the second short rail 30B are formed of a resin by molding. There is no specific limitation on the material of the first short rail 30A and the second short rail 30B. The first short rail 30A and the second short rail 30B may be formed of, for example, aluminum by die-casting.

The first short rail 30A includes a plate-like flat portion 31A, the engaged portion 32A provided at a bottom end of the flat portion 31A, a plurality of through-holes 33A running through the flat portion 31A in the sub scanning direction X, and a plurality of protrusions 34A provided at a top end of the flat portion 31A. The plate-like flat portion 31A has a front surface 31A1 and a rear surface 31A2. The first short rail 30A is attached to the printer 10 by the rear surface 31A2 being abutted against the front panel 12 of the printer 10. The engaged portion 32A is engageable with the pinch roller unit 40. The engaged portion 32A has a cylindrical shape having an axis extending in the main scanning direction Y. The bolts B1 are inserted through the plurality of through-holes 33A in order to secure the first short rail 30A to the front panel 12. The plurality of through-holes 33A run through the front surface 31A1 and the rear surface 31A2 of the flat portion 31A. The plurality of through-holes 33A are located in a line in the main scanning direction Y.

The plurality of protrusions 34A are provided at the top end of the flat portion 31A and located in a line in the main scanning direction Y. The plurality of protrusions 34A protrude upward from the top end of the flat portion 31A. Top surfaces of the plurality of protrusions 34A form a discontinuous top surface of the first short rail 30A. The top surfaces of the plurality of protrusions 34A are flat and generally parallel to the engaged portion 32A. The top surfaces of the plurality of protrusions 34A are a plurality of the positioning surfaces 34A1 abutted against the bottom surface 91*a* of the guide rail 91. The second short rail 30B includes a flat portion 31B having a front surface 31B1 and a rear surface 31B2, an engaged portion 32B, a plurality of through-holes 33B, and a plurality of protrusions 34A, which are like the counterparts of the first short rail 30A.

As shown in FIG. 7, the second short rail 30B is different in length in the main scanning direction Y from the first short rail 30A. In this preferred embodiment, the second short rail 30B is shorter than the first short rail 30A in the main scanning direction Y. The first short rail 30A and the second short rail 30B have an equal height in the up-down direction Z. More specifically, the engaged portions 32A and 32B have an equal height, the flat portions 31A and 31B have an equal height, the protrusions 34A1 and 34B1 have an equal height, and the through-holes 33A and 33B are formed at the same positions in the up-down direction Z.

As shown in FIG. 7, the engaged portion 32A of the first short rail 30A has a diameter longer than a thickness of the flat portion 31A in the sub scanning direction X. The engaged portion 32A protrudes in the front-rear direction from the flat portion 31A. The engaged portion 32A protrudes outward in the main scanning direction Y, namely, leftward and rightward in this preferred embodiment, from the flat portion 31A. The engaged portion 32B of the second short rail 30B is structured substantially similarly. The flat portion 31B of the second short rail 30B is equal in thickness in the sub scanning direction X to the flat portion 31A of the first short rail 30A. The engaged portion 32B of the second short rail 30B is equal in diameter to the engaged portion 32A of the first short rail 30A.

The plurality of through-holes 33A of the first short rail 30A are located at an equal interval. The plurality of through-holes 33A of the first short rail 30A are located at a pitch equal to a pitch of screw holes 12*a* (see FIG. 6), of the front panel 12, through which the bolts B1 are inserted to be tightened. Although not shown, the plurality of screw holes 12*a* are provided in the front panel 12 at a pitch equal to the pitch of the plurality of through-holes 33A of the first short rail 30A. The plurality of through-holes 33B of the second short rail 30B are provided at a pitch equal to the pitch of the plurality of through-holes 33A of the first short rail 30A. With such a structure, the first short rails 30A and the second short rails 30B may be attached to the front panel 12. The second short rail 30B is shorter than the first short rail 30A in the main scanning direction Y, and therefore, the number of the through-holes 33B of the second short rail 30B is smaller than the number of the through-holes 33A of the first short rail 30A.

The distance, in the main scanning direction Y, between the through-hole 33A at one end of the first short rail 30A in the main scanning direction Y (e.g., the rightmost through-hole 33A) and an end of the engaged portion 32A on the same side in the main scanning direction Y (e.g., the right end of the engaged portion 32A) is half of the pitch of the screw holes 12*a*. The distance, in the main scanning direction Y, between the through-hole 33B at one end of the second short rail 30B in the main scanning direction Y (e.g., the rightmost through-hole 33B) and an end of the engaged portion 32B on the same side in the main scanning direction Y (e.g., the right end of the engaged portion 32B) is half of the pitch of the screw holes 12*a*. With such a structure, the first short rails 30A and the second short rails 30B may be located with no gap in the main scanning direction Y.

As shown in FIG. 7, a counter bore 35A, into which a head of the bolt B1 is sunk, is formed around each of the plurality of through-holes 33A of the first short rail 30A. The counter bore 35A is provided on the front surface 31A1 of the flat portion 31A. Similarly, a counter bore 35B is formed around each of the plurality of through-holes 33B of the second short rail 30B. The counter bore 35B is provided on the front surface 31B1 of the flat portion 31B. The through-holes 33A of the first short rail 30A and the through-holes 33B of the second short rail 30B are the same as each other. The counter bores 35A of the first short rail 30A and the counter bores 35B of the second short rail 30B are the same as each other. The through-holes 33A and 33B and the counter bores 35A and 35B correspond to the bolts B1.

The first short rail 30A, before being assembled, is often warped to protrude in either one of two directions of the normal to the flat portion 31A (in FIG. 7, warped to protrude forward or rearward). In this preferred embodiment, the counter bores 35A are formed on the protruding side of the front portion 31A. As a result, the front surface 31A1 of the first short rail 30A protrudes. The counter bores 35A may be formed during the formation of the first short rail 30A of a resin by molding. In this case, the direction of the warp is controlled during the molding. Alternatively, the counter bores 35A may be formed by shaving the first short rail 30A formed of the resin. In this case, whether the counter bores 35A are to be formed on the front surface 31A1 or the rear surface 31B1 is determined based on the direction of the warp of the first short rail 30A formed by molding. This is also applicable to the second short rail 30B.

In the first short rail 30A, the plurality of protrusions 34A are respectively provided above the plurality of through-holes 33A. Therefore, the positioning surfaces 34A1 and the through-holes 33A are located in a line in the up-down direction Z. The number of the positioning surfaces 34A1 and the number of the through-holes 33A are equal to each other. The second short rail 30B has substantially the same structure. Therefore, the number of the positioning surfaces 34B1 of the second short rail 30B is smaller than the number of the positioning surfaces 34A1 of the first short rail 30A.

As described above, the plurality of first short rails 30A and the plurality of second short rails 30B are tightened with screws to the front panel 12 independently. In this preferred embodiment, the plurality of first short rails 30A and the plurality of second short rails 30B are located alternately in the main scanning direction Y. The plurality of first short rails 30A and the plurality of second short rails 30B do not need to be located alternately in the main scanning direction Y. In order to secure the first short rail 30A to the front panel 12, for example, the bolts B1 inserted through the through-holes 33A are tightened while the positioning surfaces 34A1 are pressed to the bottom surface 91*a* of the guide rail 91. As a result, the position of the first short rail 30A in the sub scanning direction X and the up-down direction Z are determined. This is also applicable to the second short rail 30B.

A short rail adjacent to one secured short rail is positioned so as to be continuous to the one secured short rail in the main scanning direction Y. For such positioning, the through-holes 33A and 33B and the counter bores 35A and 35B may have play with respect to the bolts B1. More specifically, the short rails 30A and 30B adjacent to each other are positioned such that ends of the engaged portions 32A and 32B are in contact with each other. The engaged portion 32A of the first short rail 30A and the engaged portion 32B of the second short rail 30B protrude outward in the main scanning direction Y from the flat portions 31A and 31B. Therefore, the engaged portion 32A and the engaged portion 32B may be put into contact with each other. The engaged portions 32A and 32B adjacent to each other contact each other, and as a result, the engaged portion 32 with no gap is formed.

The warp is corrected as follows. The first short rail 30A and the second short rail 30B are secured in a state where the rear surfaces 31A2 and 31B2, which are recessed, are directed toward the front panel 12. One or some of the through-holes 33A and 33B are provided at central positions of the first short rail 30A and the second short rail 30B respectively in the main scanning direction Y. Therefore, the bolts B1 inserted through the through-holes 33A and 33B are tightened to the front panel 12*a*, and as a result, the warp of the first short rail 30A and the second short rail 30B is corrected.

[Structure of the Pinch Roller Units]

Figure 8:
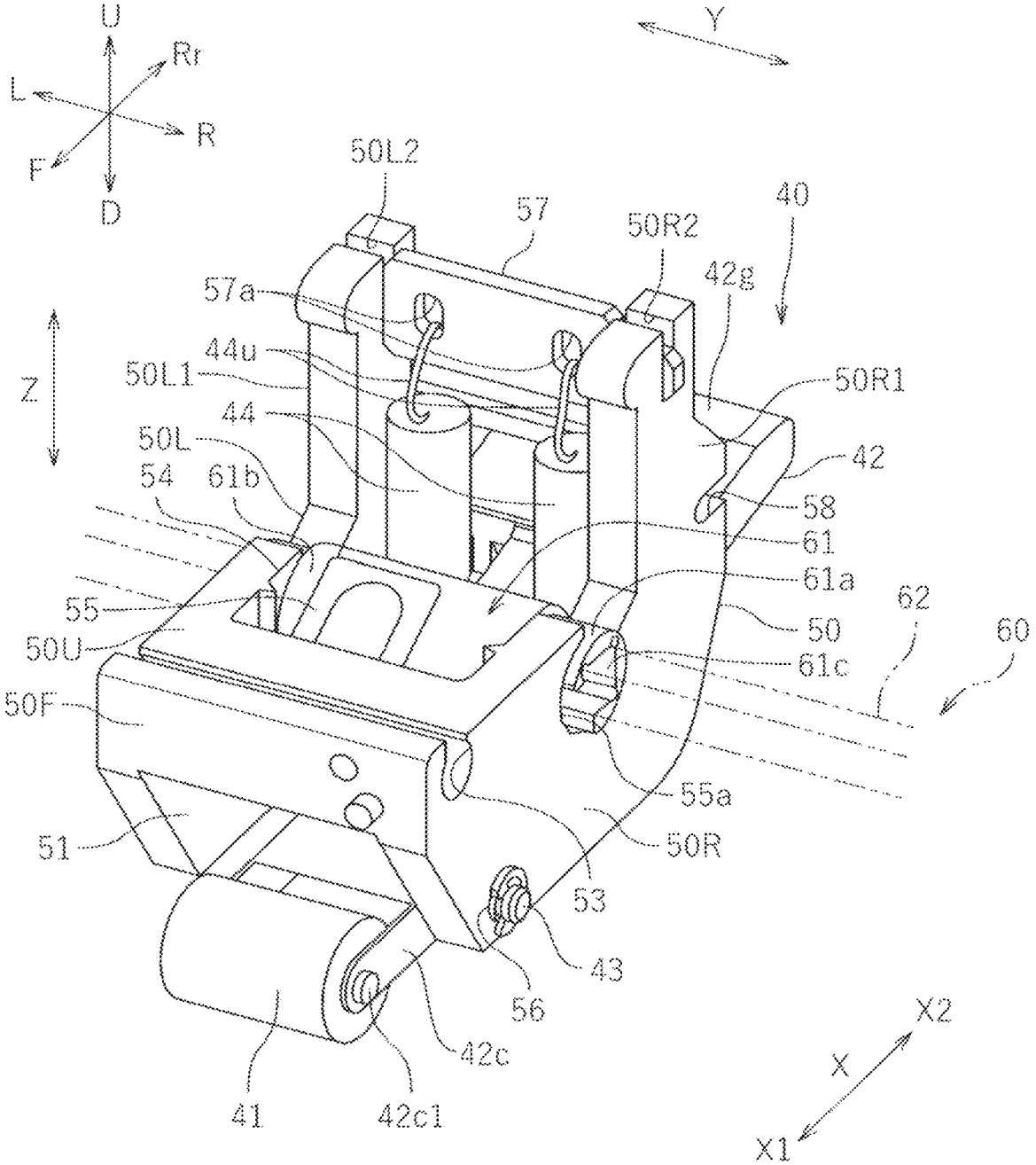
FIG. 8 is a perspective view of a pinch roller unit as seen from the front.
Figure 9:
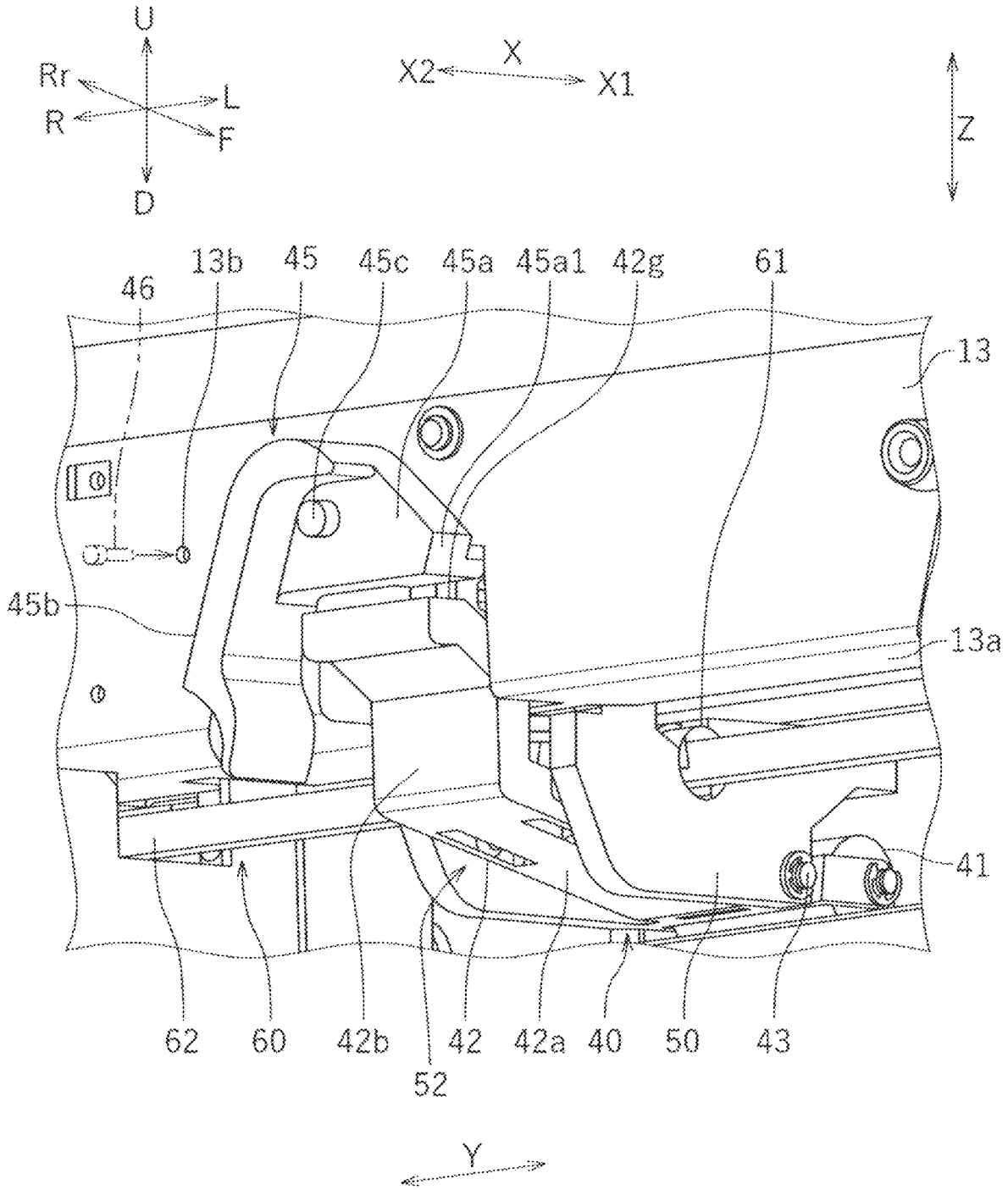
FIG. 9 is a perspective view of the pinch roller unit as seen from the rear.
Figure 10:
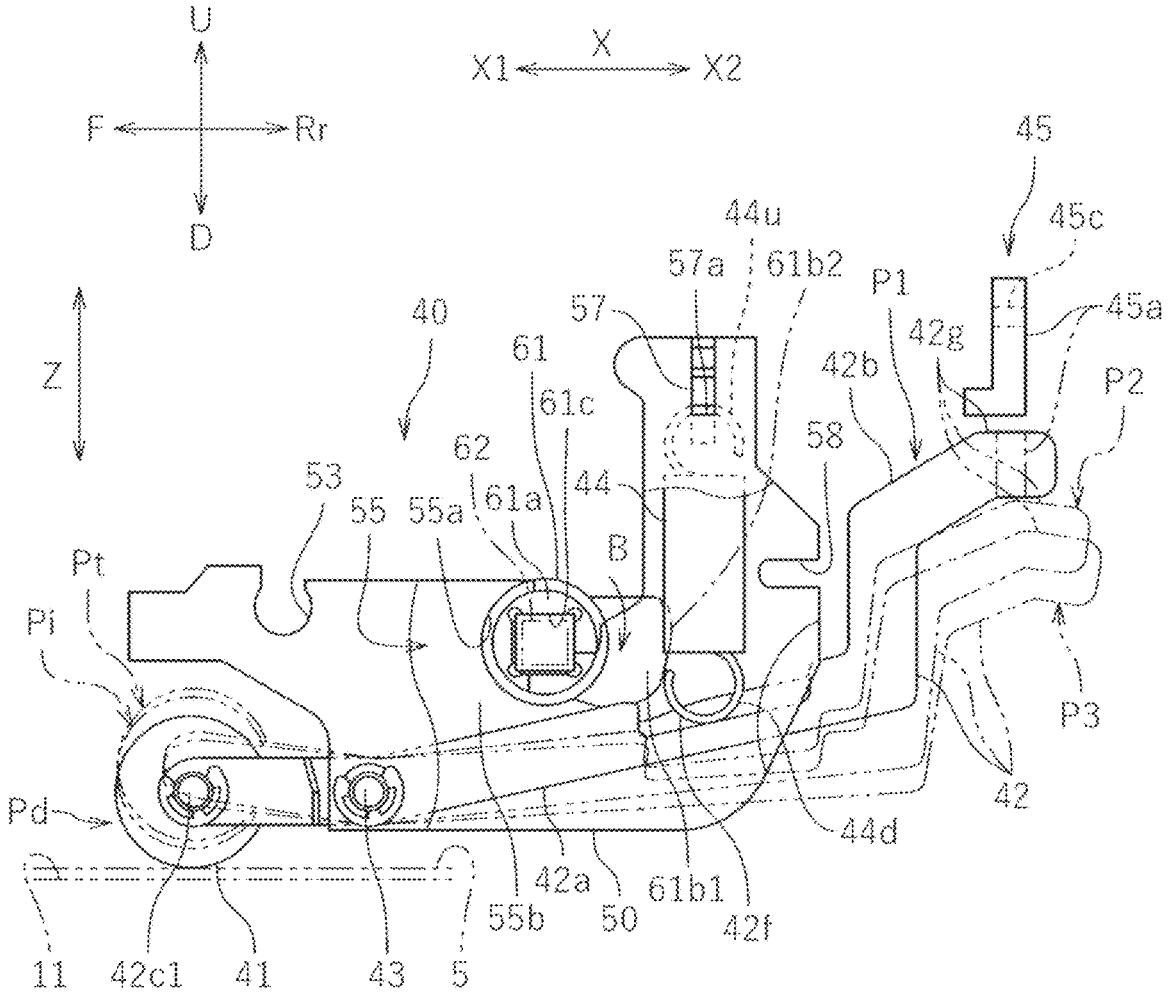
FIG. 10 is a partial cross-sectional view of the pinch roller unit taken along a plane extending in the sub scanning direction the up-down direction.
Figure 11:
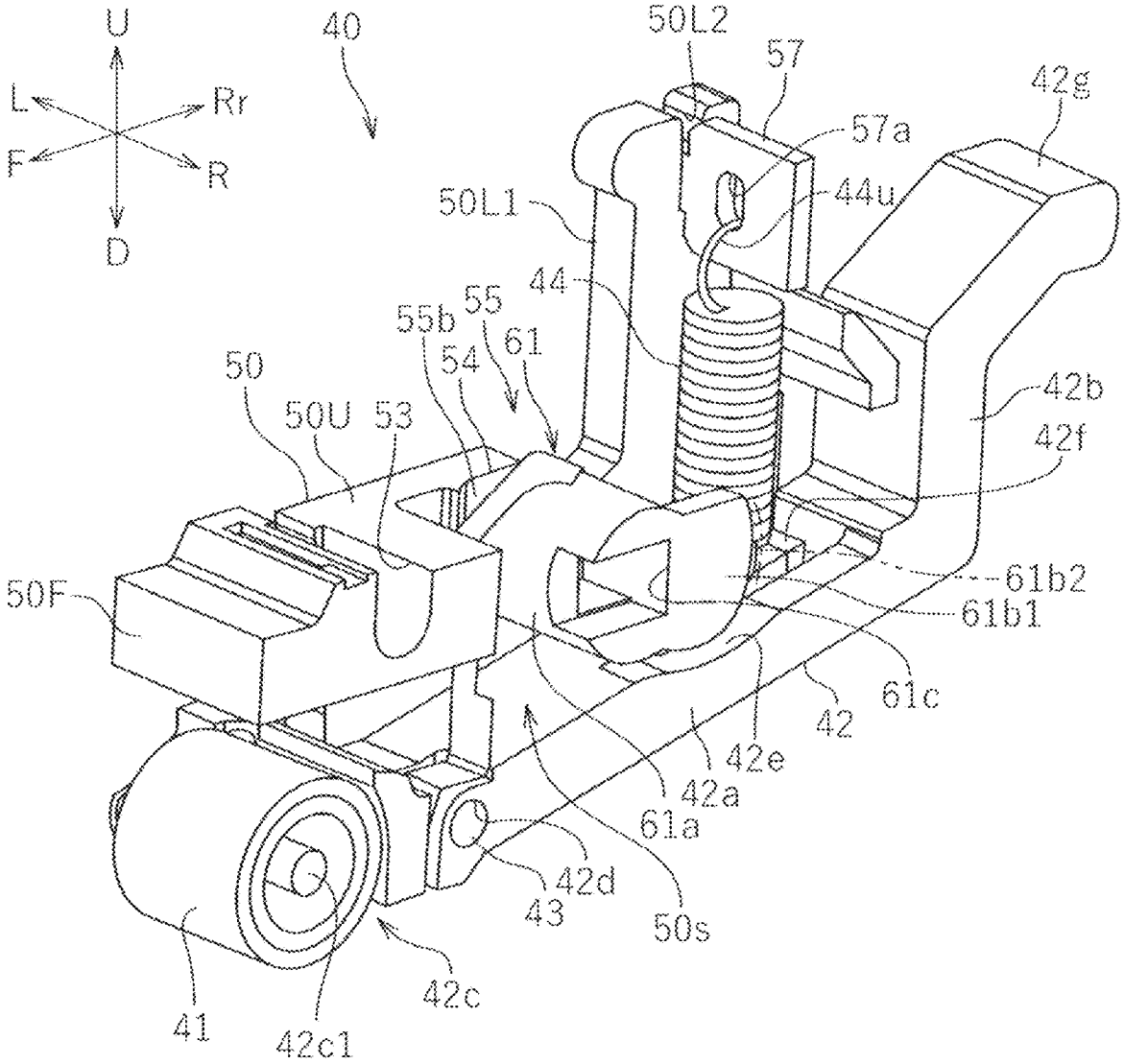
FIG. 11 is a perspective view of a part of the pinch roller unit cut along a plane extending in the sub scanning direction and the up-down direction.
Figure 12:
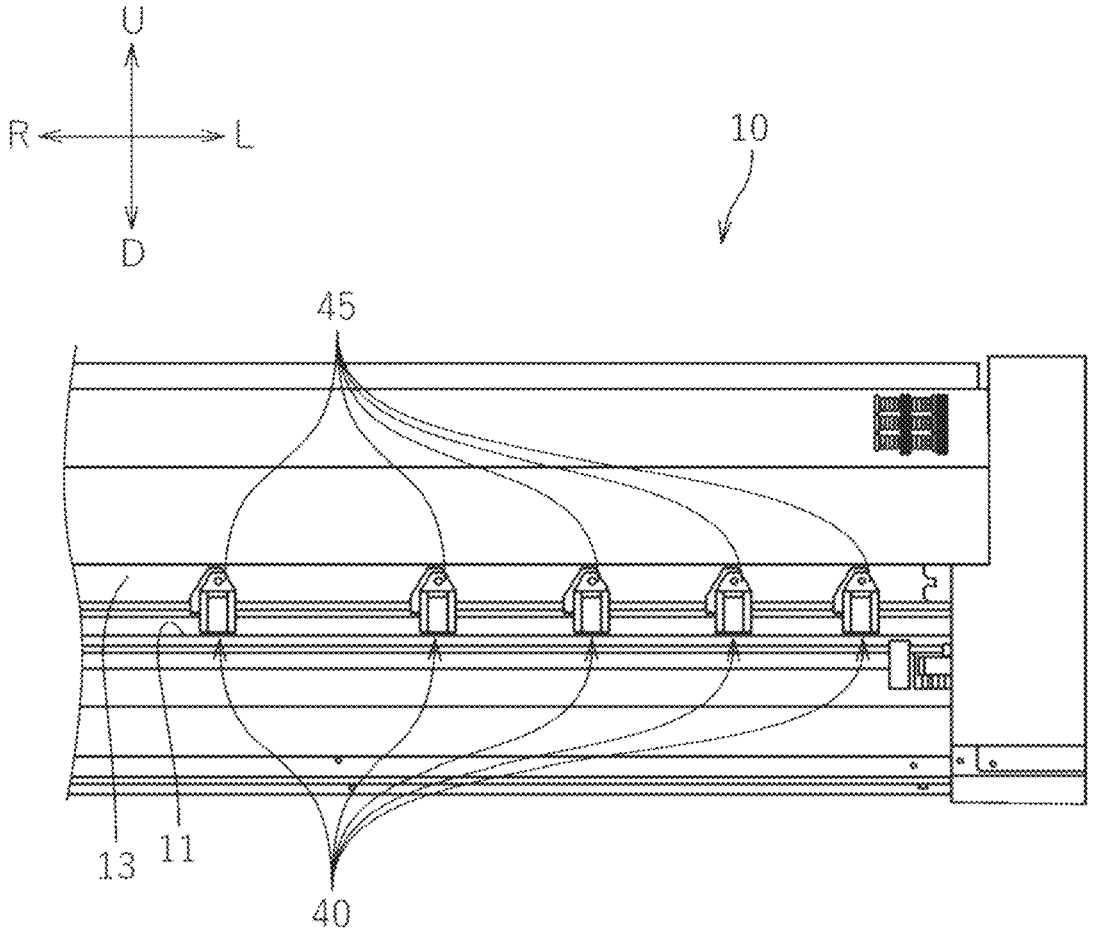
FIG. 12 is a rear view of the printer.

Now, a structure of the pinch roller units 40 will be described. As described above, the pinch roller units 40 press or release the medium 5, and each include the pinch roller 41 pressing the medium 5. FIG. 8 is a perspective view of one pinch roller unit 40 as seen from the front. FIG. 9 is a perspective view of one pinch roller unit 40 as seen from the rear. FIG. 10 is a partial cross-sectional view of one pinch roller unit 40 taken along a plane extending in the sub scanning direction X and the up-down direction Z. FIG. 11 is a perspective view of a part of one pinch roller unit 40 cut along a plane extending in the sub scanning direction X and the up-down direction Z. FIG. 12 is a rear view of the printer 10 including the plurality of pinch roller units 40. As shown in FIG. 8 through FIG. 11, the pinch roller unit 40 includes the pinch roller 41, a main body 50 engageable with the pinch rail 30, a roller holder 42 swingably supported by the main body 50 and supporting the pinch roller 41, a swing shaft about which the roller holder 42 is swingable, springs 44 loading the roller holder 42, and the actuator 45 elevating the roller holder 42 up or down. In this preferred embodiment, the pinch roller 41, the roller holder 42, the swing shaft 43 and the springs 44 are directly or indirectly supported by the main body 50. As shown in FIG. 9, in this preferred embodiment, the actuator 45 is supported by a rear panel 13 of the printer 10. Alternatively, the actuator 45 may be supported by the main body 50. FIG. 8 and FIG. 11 omit the actuator 45.

As shown in FIG. 8, the main body 50 is like a hollow box. The main body 50 includes a front wall 50F, a left side wall 50L, a right side wall 50R, and a top wall 50U. The front wall 50F, the left side wall 50L, the right side wall 50R and the top wall 50U enclose an inner space 50*s* (see FIG. 11). The roller holder 42 is accommodated in the inner space 50*s*. A global elevation cam 61 (described below in detail) of the overall elevation mechanism 60 is also accommodated in the inner space 50*s*.

The front wall 50F includes a front opening 51, through which a front end of the roller holder 42 protrudes. As shown in FIG. 9, a rear end of the main body 50 is opened to form a rear opening 52, through which a rear end of the roller holder 42 protrudes. The front end of the roller holder 42 protrudes to the outside of the inner space 50*s* through the front opening 51. The rear end of the roller holder 42 protrudes to the outside of the inner space 50*s* through the rear opening 52.

The top wall 50U extends from a front end of the main body 50 to a central position thereof in the sub scanning direction X. The top wall 50U includes an engageable groove 53 and a top opening 54. As shown in FIG. 6, the engageable groove 53 is engageable with the engaged portion 32 of the pinch rail 30. As shown in FIG. 8, the engageable groove 53 is provided in the vicinity of a front end of the top wall 50U. The engageable groove has a cylindrical shape corresponding to the shape of the engaged portion 32 of the pinch rail 30, and extends in the main scanning direction Y. The engageable groove 53 runs throughout the top wall 50U in the main scanning direction Y. The engageable groove 53 reaches the left side wall 50L and the right side wall 50R. For attaching the main body 50 and the pinch rail 30 to each other, the engaged portion 32 of the pinch rail 30 is inserted into the engageable groove 53 running throughout the top wall 50U.

The top opening 54 is provided to the rear of the engageable groove 53. The top opening 54 runs up to a rear end of the top wall 50U. As shown in FIG. 11, the global elevation cam 61 is inserted into the inner space 50*s* of the main body 50 through the top opening 54.

As shown in FIG. 8, the left side wall 50L and the right side wall 50R respectively include a left support arm 50L1 and a right support arm 50R1 in rear portions thereof. The left support arm 50L1 and the right support arm 50R1 extend upward, and thus the left side wall 50L and the right side wall 50R are L-shaped. The left support arm 50L1 and the right support arm 50R1 are provided in a line in the main scanning direction Y. The left support arm 50L1 and the right support arm 50R1 respectively have top surfaces, and the top surfaces respectively have grooves 50L2 and 50R2 recessed so as to extend in the main scanning direction Y and in the up-down direction Z.

A space between the top surface 50U and the left and right support arms 50L1 and 50R1 has a top opening. A pair of cam bearings 55*a* are respectively provided in a part of the left side wall 50L that is to the left of the top opening and in a part of the right side wall 50R that is to the right of the top opening. The pair of cam bearings 55*a* are generally circular through-holes respectively running through the left side wall 50L and the right side wall 50R in the main scanning direction Y. The pair of cam bearings 55*a* have top openings. The pair of cam bearings 55*a* receive a shaft portion 61*a* (described below) of the global elevation cam 61. The pair of cam bearings 55*a*, an open space between the pair of cam bearings 55*a*, and a space below the top opening 54 (hereinafter, the space below the top opening 54 will be referred to as a cam accommodation space 55*b*) form a cam accommodation portion 55 accommodating the global elevation cam 61.

A pair of swing bearings 56 are provided respectively in the vicinity of front bottom corners of the left side wall 50L and the right side wall 50R. The pair of swing bearings 56 are through-holes running through the left side wall 50L and the right side wall 50R in the main scanning direction Y.

A spring engaging member 57 extends between the left support arm 50L1 and the right support arm 50R1. The spring engaging member 57 is like a flat plate, and is inserted into the groove 50L2 in the top surface of the left support arm 50L1 and the groove 50R2 in the top surface of the right support arm 50R1. Alternatively, the left support arm 50L1, the right support arm 50R1 and the spring engaging member 57 may be integrally formed. The spring engaging member 57 includes two spring engaging portions 57*a*. In this preferred embodiment, the spring engaging portions 57*a* are through-holes running through the spring engaging member 57 in the sub scanning direction X. The pair of spring engaging portions 57*a* are provided in a line in the main scanning direction Y.

As shown in FIG. 8, the left side wall 50L and the right side wall 50R respectively include a pair of rotation stop portions 58 in rear surfaces thereof. The pair of rotation stop portions 58 are grooves respectively formed in the rear surfaces of the left side wall 50L and the right side wall 50R, and extend in the main scanning direction Y. The pair of rotation stop portions 58 are recessed forward from the rear surfaces of the left side wall 50L and the right side wall 50R. As shown in FIG. 6, the rear panel 13 of the printer 10 includes a folded portion 13*a* folded forward. The folded portion 13*a* is inserted into the pair of rotation stop portions 58. This structure prevents the main body 50 from rotating in the front-rear direction.

The roller holder 42 is accommodated in the inner space 50*s* of the main body 50, and is swingably supported by the swing shaft 43. As shown in FIG. 8, the swing shaft 43 is inserted into the pair of swing bearings 56. The swing shaft 43 extends in the main scanning direction Y in a front bottom portion of the pinch roller unit 40.

The roller holder 42 supports the pinch roller 41 so as to cause the pinch roller 41 to contact, or to be spaced from, the grit roller 21. The roller holder 42 swings while supporting the pinch roller 41, and as a result, causes the pinch roller 41 to contact, or to be spaced from, the grit roller 21. As shown in FIG. 11, the roller holder 42 is like a plate extending in the sub scanning direction X. A portion that is about two-thirds of the roller holder 42 from the front end thereof is a flat portion 42*a* generally horizontal in the inner space 50*s* of the main body 50. A portion, of the roller holder 42, to the rear of the flat portion 42*a* is an arm portion 42*b* bent upward. The arm portion 42*b* is further bent such that a rear end thereof is generally horizontal. As shown in FIG. 11, the roller holder 42 includes a roller support portion 42*c*, a swing shaft insertion portion 42*d*, a global elevation cam receiving portion 42*e*, a spring engaging portion 42*f*, and an individual elevation cam receiving portion 42*g*. Among these components, the roller support portion 42*c*, the swing shaft insertion portion 42*d*, the global elevation cam receiving portion 42*e* and the spring engaging portion 42*f* are provided in the flat portion 42*a*. The individual elevation cam receiving portion 42*g* is provided in the arm portion 42*b*.

The roller support portion 42*c* is provided in a front end portion of the flat portion 42*a*, namely, in a front end portion of the roller holder 42. The roller support portion 42*c* includes a rotation shaft 42*c*1 extending in the main scanning direction Y. The roller support portion 42*c* supports the pinch roller 41 such that the pinch roller 41 is rotatable about the rotation shaft 42*c*1. With such a structure, the pinch roller 41 is rotatable in the sub scanning direction X. The pinch roller 41 is cylindrical. An axis line of the pinch roller 41 extends in the main scanning direction Y. The pinch roller 41 is supported by the roller holder 42, and thus is located so as to face the grit roller 21. The pinch roller 41 approaches, or is distanced from, the grit roller 21 by a swing of the roller holder 42.

The swing shaft insertion portion 42*d* is provided to the rear of the roller support portion 42*c*. The swing shaft insertion portion 42*d* is a through-hole running in the main scanning direction Y. The swing shaft 43 is inserted through the swing shaft insertion portion 42*d*. The roller holder 42 is swingable about the swing shaft 43. The roller holder 42 swings about the swing shaft 43, and as a result, the pinch roller 41 supported by the front end portion of the roller holder 42 moves in the up-down direction Z. More specifically, when a portion of the roller holder 42 that is to the rear of the swing shaft 43 is pressed downward, the pinch roller 41, which is located to the front of the swing shaft 43, moves upward. When the portion of the roller holder 42 that is to the rear of the swing shaft 43 is pulled upward, the pinch roller 41 moves downward. A portion of the flat portion 42*a* that is to the rear of the swing shaft insertion portion 42*d* is longer than a portion thereof that is to the front of the swing shaft insertion portion 42*d*.

The global elevation cam receiving portion 42*e* is included in the flat portion 42*a* and is provided to the rear of the swing shaft insertion portion 42*d*. In this preferred embodiment, the distance between the global elevation cam receiving portion 42*e* and the swing shaft insertion portion 42*d* is longer than the distance between the pinch roller 41 and the swing shaft insertion portion 42*d*. The global elevation cam receiving portion 42*e* is to be pressed by the global elevation cam 61. As shown in FIG. 11, the global elevation cam receiving portion 42*e* is located below the cam accommodation space 55*b*. The global elevation cam 61 is located above the global elevation cam receiving portion 42*e* when being accommodated in the pinch roller unit 40. The global elevation cam receiving portion 42*e* is recessed while being curved downward such that the global elevation cam 61 slides thereon while being rotated. When the global elevation cam 61 is rotated to press the global elevation cam receiving portion 42*e* downward, the pinch roller 41 moves upward.

The spring engaging portion 42*f* is included in the flat portion 42*a* and is provided to the rear of the global elevation cam receiving portion 42*e*. The spring engaging portion 42*f* is allowed to be hooked with a bottom end hook 44*d* (see FIG. 10) provided at a bottom end of each of the pair of springs 44. When the springs 44 are contracted to pull the spring engaging portion 42*f* upward, the pinch roller 41 moves downward.

The individual elevation cam receiving portion 42*g* is provided in a rear end portion of the arm portion 42*b*. The individual elevation cam receiving portion 42*g* is a generally horizontal flat plane provided in the rear end portion of the arm portion 42*b*. The individual elevation cam receiving portion 42*g* is to be pressed by the actuator 45. As described below in detail, when being operated by the user, the actuator 45 presses the individual elevation cam receiving portion 42*g* downward. When the individual elevation cam receiving portion 42*g* is pressed downward, the pinch roller 41 moves upward.

The pair of springs 44 are in engagement with the pair of spring engaging portions 57*a* of the spring engaging member 57 and with the spring engaging portion 42*f* of the roller holder 42. As shown in FIG. 10 in detail, the springs 44 are located upright, and a top end hook 44*u* provided at a top end of each of the springs 44 is hooked with the corresponding spring engaging portion 57*a*. The bottom end hook 44*d* provided at the bottom end of each of the springs 44 is hooked with the spring engaging portion 42*f* of the roller holder 42. The springs 44 are in engagement with the spring engaging portions 57*a* and 42*f* in a stretched state. Therefore, the springs 44 pull the spring engaging portion 42*f* upward. As a result, the springs 44 load the pinch roller 41 downward. While the global elevation cam 61 or the actuator 45 is not pressing the roller holder 42, the pinch roller 41 is pressed downward by a restoring force of the springs 44.

The actuator 45 causes the pinch roller 41 to contact, or to be spaced from, the grit roller 21. The actuator 45 is provided for each of the pinch roller units 40, and individually elevates up or down the pinch roller 41 of the pinch roller unit in which the actuator 45 is provided. In this preferred embodiment, the actuator 45 swings the roller holder 42, holding the pinch roller 41, in accordance with the operation of the user, and thus causes the pinch roller 41 to contact, or to be spaced from, the grit roller 21.

As shown in FIG. 9, the actuator 45 is provided above the individual elevation cam receiving portion 42*g* of the roller holder 42 so as to be contactable with the individual elevation cam receiving portion 42*g*. In this preferred embodiment, the actuator 45 is provided on the rear panel 13 of the printer 10. In this preferred embodiment, as shown in FIG. 12, the rear panel 13 is provided upstream in the sub scanning direction X, namely, on the X2 side, with respect to the pinch roller 41, and is exposed in the X2 direction. The actuator 45 in each of the pinch roller units 40 provided on the rear panel 13 is viewable from the rear of the printer 10. The actuator 45 in each pinch roller unit 40 is operable from the rear of the printer 10. In this preferred embodiment, the actuator 45 is located at the rearmost position among the components of the pinch roller unit 40. It is sufficient that the actuator 45 is located to the rear of at least the pinch roller 41 and is manually operable by the user. As shown in FIG. 9, the actuator 45 is like a plate expanding along a plane extending in the up-down direction Z.

Figure 13:
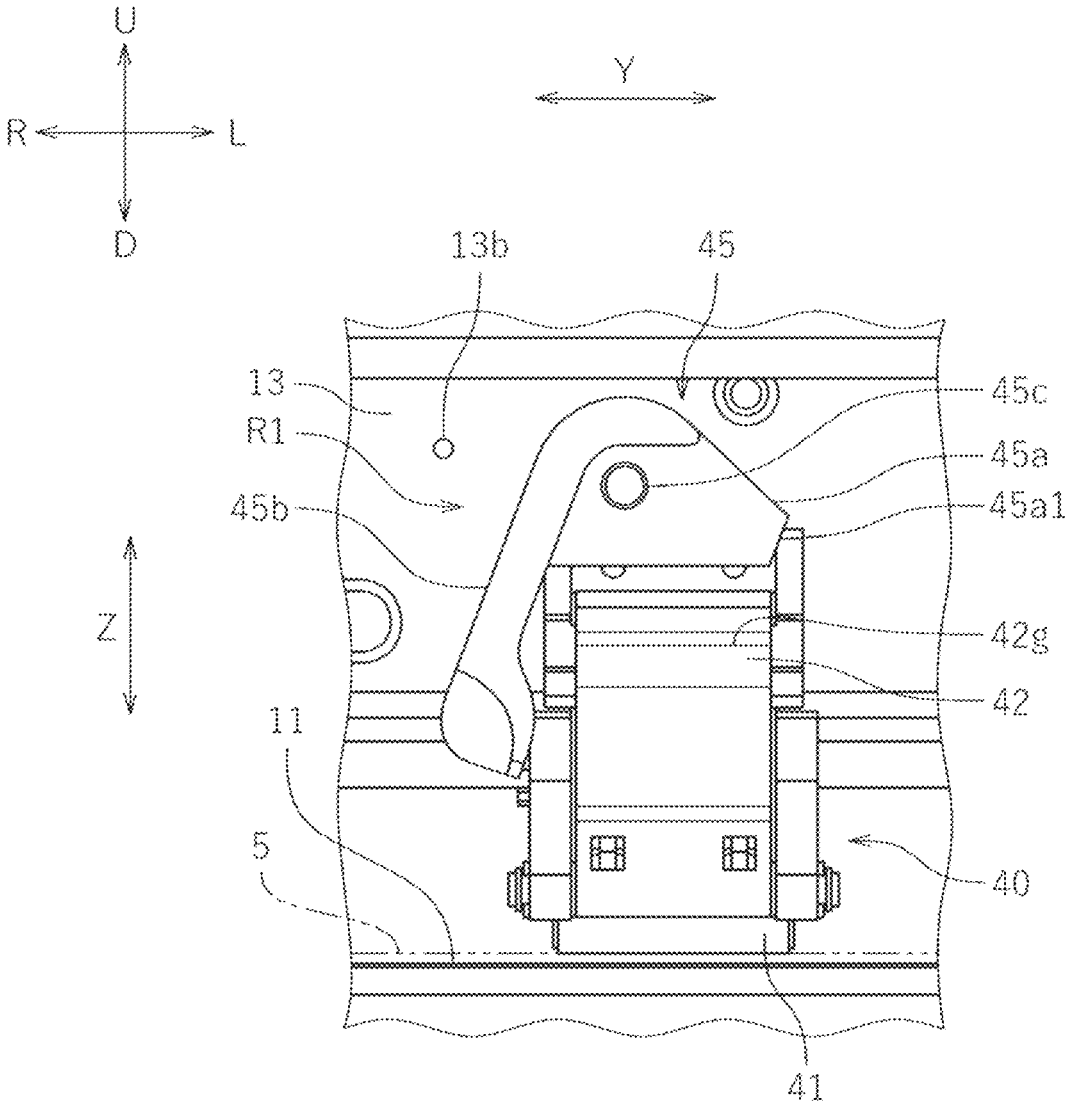
FIG. 13 is a rear view of the pinch roller unit in a state where an actuator is not in contact with a roller holder.
Figure 14:
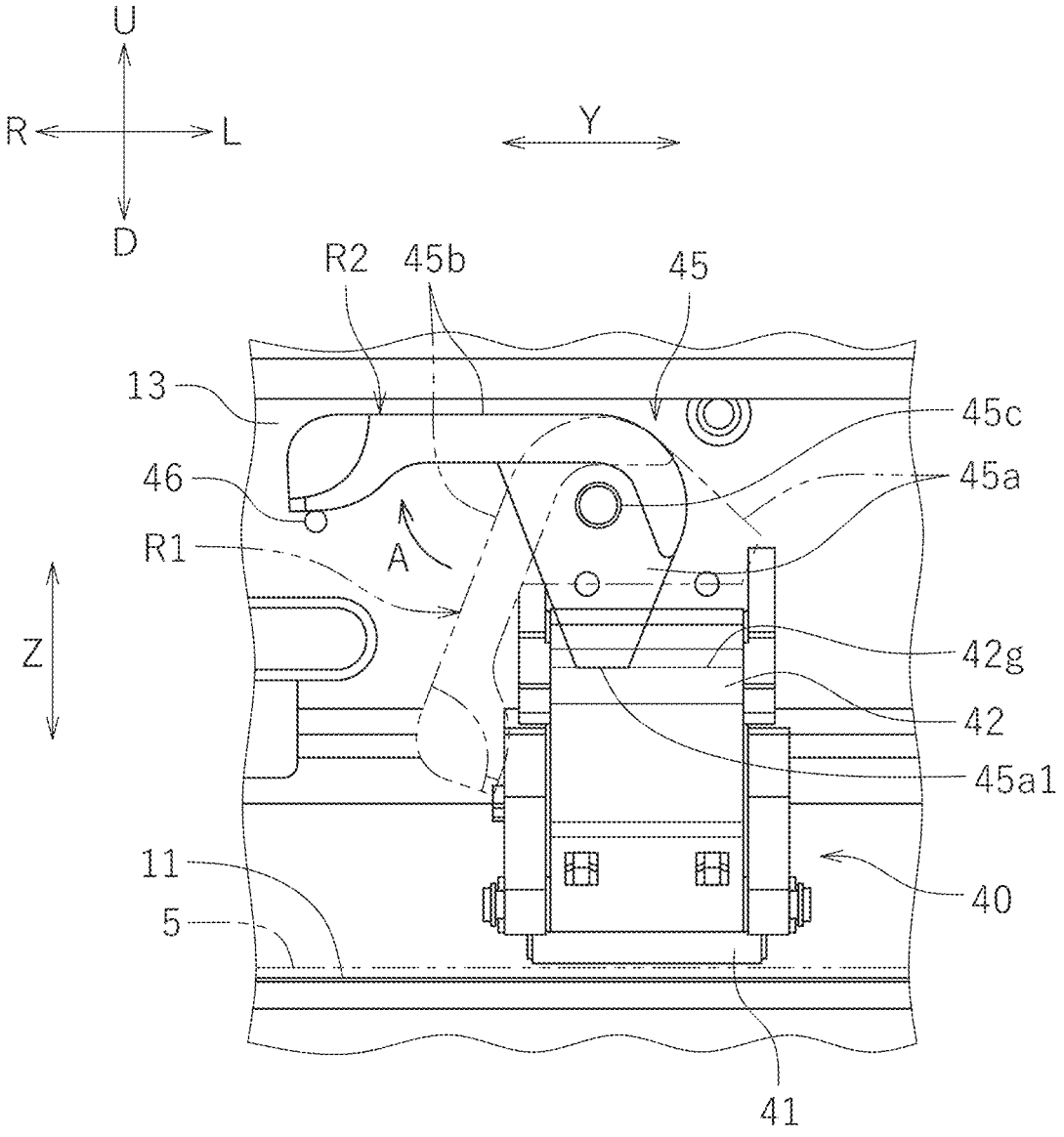
FIG. 14 is a rear view of the pinch roller unit in a state where the actuator is in contact with the roller holder.

FIG. 13 is a rear view of the pinch roller unit 40 in a state where the actuator 45 is not in contact with the roller holder 42. As shown in FIG. 13, the actuator 45 includes a cam 45*a*, a lever 45*b*, and a rotation shaft 45*c*. The rotation shaft 45*c* is provided on the rear panel 13, and extends in the sub scanning direction X. The cam 45*a* is supported by the rotation shaft 45*c* so as to be rotatable about the rotation shaft 45*c*. The cam 45*a* is an eccentric cam, which has an outer circumferential surface, different positions on which have different distances from the rotation shaft 45*c*. In this preferred embodiment, the cam 45*a* is generally triangular as seen in the rear view. The rotation shaft 45*c* is located at a position off from the center of the cam 45*a*. The cam 45*a* includes a contact portion 45*a*1 contacting, or separated from, the roller holder 42, in accordance with the position thereof in a rotation direction. The contact portion 45*a*1 is provided on the outer circumferential surface of the cam 45*a*, more specifically, at one of apexes of the generally triangular cam 45*a*. In this preferred embodiment, the contact portion 45*a*1 is a plane formed by the apex being cut off. As shown in FIG. 13, as seen in the rear view, the apex of the general triangle at which the contact portion 45*a*1 is provided is farthest from the rotation shaft 45*c*. Therefore, the distance between the contact portion 45*a*1 and the rotation shaft 45*c* is longer than the distance between any other position on the other circumferential surface of the cam 45*a* and the rotation shaft 45*c*. The contact portion 45*a*1 is allowed to contact the individual elevation cam receiving portion 42*g* of the roller holder 42 by a rotation of the actuator 45. FIG. 14 is a rear view of the pinch roller unit 40 in a state where the actuator 45 is in contact with the roller holder 42. As shown in FIG. 14, the actuator 45 is rotated in a direction of arrow A, and as a result, the contact portion 45*a*1 contacts the individual elevation cam receiving portion 42*g* of the roller holder 42.

The lever 45*b* extends to be along a side, of the cam 45*a*, that faces the contact portion 45*a*1. The lever 45*b* extends in a direction generally parallel to the direction in which the contact portion 45*a*1 extends. The lever 45*b* extends in the above-described direction and protrudes to the outside of the cam 45*a*. The lever 45*b* is an example of a handle that is connected with the cam 45*a* and is capable of rotating the cam 45*a*. The user may hold the lever 45*b* to rotate the actuator 45. In this preferred embodiment, the lever 45*b* is integrally formed with the cam 45*a*. Alternatively, the lever 45*b* may be formed separately from the cam 45*a* and attached to the cam 45*a*. The cam 45*a* and the lever 45*b* form an operation portion that presses the contact portion 45*a*1 to the roller holder 42 and thus is capable of moving the pinch roller 41 in a direction away from the grit roller 21.

As shown in FIG. 9, the rear panel 13 includes a stopper attachment portion 13*b*. A stopper 46 may be attached to, or detached from, the stopper attachment portion 13*b*. When being needed, the stopper 46 is attached to the stopper attachment portion 13*b* by the user. When not being needed, the stopper 46 is detached from the stopper attachment portion 13*b*. In this preferred embodiment, the stopper attachment portion 13*b* is a screw hole. The stopper 46 is a screw screwable with the stopper attachment portion 13*b*. The stopper attachment portion 13*b* is provided on a route on which the lever 45*b* moves. The stopper 46 inhibits the actuator 45 from returning to the position shown in FIG. 13 from the position shown in FIG. 14. How to use the stopper 46 will be described below.

[Structure of the Overall Elevation Mechanism]

The overall elevation mechanism 60 elevates up or down all the pinch rollers 41 in the plurality of pinch roller units 40 at the same time. The overall elevation mechanism 60 is capable of causing all the pinch rollers 41 in the plurality of pinch roller units 40 to contact, or to be spaced from, the grit rollers 21. The overall elevation mechanism 60 is capable of holding all the pinch rollers 41 spaced from the grit rollers 21. As described below, the overall elevation mechanism 60 is also capable of releasing, at the same time, all the pinch rollers 41 in the plurality of pinch roller units 40 from a state of being held by the actuators 45.

As shown in FIG. 8, the overall elevation mechanism 60 includes the plurality of global elevation cams 61 accommodated in the inner space 50*s* of the pinch roller units 40, a shaft 62 coupled with the plurality of global elevation cams 61, and a pinch roller lever 63 (see FIG. 1) rotating the shaft 62. As shown in FIG. 9, the shaft 62 extends in the main scanning direction Y. The shaft 62 is rectangular as seen in an axial direction thereof. The shaft 62 is provided so as to extend above at least the entirety of the platen 11 in the main scanning direction Y. Although not shown, the pinch roller lever 63 is coupled with the shaft 62. An upward or a downward movement of the pinch roller lever 63 may rotate the shaft 62 about an axis line thereof. The overall elevation mechanism 60 includes a holding mechanism (not shown) holding the pinch roller lever 63 and the shaft 62. The shaft 62 is inserted through the plurality of global elevation cams 61, and the plurality of global elevation cams 61 rotate together with the shaft 62.

As shown in FIG. 8, the plurality of global elevation cams 61 each include a pair of shaft portions 61*a*, an eccentric portion 61*b*, and a shaft hole 61*c*. The eccentric portion 61*b* is accommodated in the cam accommodation space 55*b* of the pinch roller unit 40. The pair of shaft portions 61*a* extend leftward and rightward from the eccentric portion 61*b*, and are respectively attached to the cam bearings 55*a*. The shaft hole 61*c* runs through the pair of shaft portions 61*a* and the eccentric portion 61*b* in the main scanning direction Y. The shaft hole 61*c* is rectangular in correspondence with the shaft 62 as seen in an axis line direction thereof. The shaft 62 and the shaft hole 61*c* have rectangular cross-sections. Therefore, when the shaft 62 rotates, the global elevation cam 61 rotates together with the shaft 62 without slipping on the shaft 62.

The shaft portions 61*a* are cylindrical in correspondence with the cam bearings 55*a*. The shaft portions 61*a* are inserted from above into the cam bearings 55*a*, which are opened upward. The shaft hole 61*c* is formed such that the center thereof matches the center of each of the shaft portions 61*a*. Therefore, when the shaft 62 rotates, the shaft portions 61*a* rotate without being decentered. The shaft portions 61*a* each rotate along an inner circumferential surface of the corresponding cam bearing 55*a*.

As shown in FIG. 11, the eccentric portion 61*b* acts as an eccentric cam. The pair of shaft portions 61*a* and the eccentric portion 61*b* are continuous with each other and act as one component. The eccentric portion 61*b* includes a protrusion portion 61*b*1 protruding outward in a radial direction from the shaft portions 61*a* as seen in an axis line direction thereof. As shown in FIG. 11, in a state where the eccentric portion 61*b* is located at such a rotation position that the protrusion portion 61*b*1 extends rearward, the protrusion portion 61*b*1 is not in contact with the roller holder 42. Such a state is provided when the pinch roller lever 63 is operated to elevate the pinch roller 41 down. In a state where the pinch roller 41 is not allowed to be elevated down any further as a result of hitting the medium 5 or the grit roller 21, the eccentric portion 61*b* is separated from the roller holder 42. In this state, the pinch roller 41 is pressed downward by a contracting force of the springs 44. In order to provide a pressing force of the pinch roller 41, the distance between the spring engaging portion 42*f* and the swing shaft insertion portion 42*d* is set to be longer than the distance between the pinch roller and the swing shaft insertion portion 42*d*. With such a structure, a pressing force stronger than the contracting force of the springs 44 is provided based on the principle of leverage.

The distance between the protrusion portion 61*b*1 and the center of the shaft hole 61*b* (center of rotation of the global elevation cam 61) varies in accordance with the position of the protrusion portion 61*b*1 in a circumferential direction. The protrusion portion 61*b*1 includes a contact portion 61*b*2 contactable with the global elevation cam receiving portion 42*e* in a state where the pinch roller 41 is elevated down to the lowermost position. The pinch roller lever 63 is operated to rotate the shaft 62 in a direction of arrow B in FIG. 10, and thus the contact portion 62*b*2 may be put into contact with the global elevation cam receiving portion 42*e*. As a result, the roller holder 42 is pressed downward by the global elevation cam 61. When this occurs, the global elevation cam receiving portion 42*e* moves downward against the contacting force of the springs 44 to elevate the pinch roller 41 up. When the pinch roller lever 63 is held, the pinch roller 41 is held spaced from the grit roller 21.

As described above, the overall elevation mechanism 60 includes the shaft 62 and the plurality of global elevation cams 61, which act as an overall swing member that swings all the roller holders 42. The overall elevation mechanism 60 further includes the pinch roller lever 63 connected with the overall swing member (more specifically, the shaft 62 in this preferred embodiment) and capable of operating the overall swing member (the shaft 62 and the plurality of global elevation cams 61 in this preferred embodiment). The overall elevation mechanism 60 is capable of causing all the pinch rollers 41 in the plurality of pinch roller units 40 to contact, or to be spaced from, the grit rollers 21, and is also capable of holding all the pinch rollers 41 spaced from the grit rollers 21.

[Individual Elevation of the Pinch Rollers and Global Release of the Pinch Rollers from a State of being Held Individually]

Hereinafter, individual elevation of the pinch rollers 41 and global release of the pinch rollers 41 from a state of being held individually will be described. In a state of not being raised by the overall elevation mechanism 60, all the pinch rollers 41 are basically elevated down by a loading force of the springs 44 and are in contact with the medium 5 or the grit rollers 21. Hereinafter, the position of each of the pinch rollers 41 in the up-down direction Z in the state where the pinch roller 41 is in contact with the medium 5 or the grit roller 21 will be referred to also as a down position Pd (see FIG. 10). As shown in FIG. 10, in a state where the pinch roller 41 is at the down position Pd, the individual elevation cam receiving portion 42*g* of the roller holder 42 is at a first position P1. Printing and cutting are usually performed in a state where all the pinch rollers 41 are at the down position Pd.

There is a case where a part of the pinch rollers 41 needs to be elevated up and separated from the medium 5 during printing or cutting. In the case where, for example, a part of the medium 5 is unexpectedly floated, the pinch roller 41 that is on a route of the floating part of the medium 5 needs to be elevated up in order to avoid collision of the pinch roller 41 and the floating part of the medium 5. In this preferred embodiment, in such a case, the actuator 45 of the pinch roller unit 40 may be operated to elevate the pinch roller 41 up.

In a state of not raising the pinch roller 41, the actuator 45 is at the position shown in FIG. 13. Hereinafter, the position of the actuator 45 in this state will be referred to as a "separated position R1". As shown in FIG. 13, the actuator 45 at the separated position R1 is separated from the roller holder 42. In the state shown in FIG. 13, the pinch roller 41 is elevated down and presses the medium 5 from above. In the state where the actuator 45 is at the separated position R1, a bottom end of the cam 45*a* of the actuator 45 is located above the individual elevation cam receiving portion 42*g*, which is at the first position P1. As shown in FIG. 10, the individual elevation cam receiving portion 42*g* moves below the first position P1. Therefore, the pinch roller 41 is freely movable in the state where the actuator 45 is at the separated position R1. The pinch roller 41 is usually elevated down by the overall elevation mechanism 60 during printing or cutting. When the medium 5 is, for example, to be replaced, the pinch roller 41 is separated from the medium 5 or the grit roller 21 by the overall elevation mechanism 60. As shown in FIG. 13, in the state where the actuator 45 is at the separated portion R1, the lever 45*b* is directed downward.

When wishing to individually elevate the pinch roller 41 up, the user rotates the lever 45*b* upward (in the direction of arrow A in FIG. 14) from the position shown in FIG. 13. As shown in FIG. 14, when the lever 45*b* is rotated to be generally horizontal, the contact portion 45*a*1 generally parallel to the lever 45*b* also becomes generally horizontal. At this point, the contact portion 45*a*1 moves to a position below the individual elevation cam receiving portion 42*g* at the first position P1. Therefore, the individual elevation cam receiving portion 42*g* is pressed down by the actuator 45. Hereinafter, the position of the actuator 45 in this state will be referred to also as a "holding position R2". The actuator 45 is movable between the holding position R2 and the separated position R1 in accordance with the operation made on the lever 45*b*. Referring to FIG. 10, "P2" is the position of the individual elevation cam receiving portion 42*g* in a state where the actuator 45 is moved to the holding position R2. Hereinafter, the position of the individual elevation cam receiving portion 42*g* in this state will be referred to also as a "second position P2". As shown in FIG. 10, when the individual elevation cam receiving portion 42*g* moves to the second position P2, the pinch roller 41 is elevated up from the down position Pd to an individual up position Pi.

In the state where the actuator 45 is at the holding position R2, the contact portion 45*a*1 receives an upward force from the individual elevation cam receiving portion 42*g*. This upward force provides a force of friction between the contact portion 45*a*1 and the individual elevation cam receiving portion 42*g*. Therefore, the actuator 45 is held at the holding position R2. In the state where the actuator 45 is at the holding position R2, the pinch roller 41 is at the individual up position Pi, in other words, is held spaced from the grit roller 21. The pinch roller unit 40 is capable of holding the pinch roller 41 spaced from the grit roller 21 by operating the actuator 45.

In the state where the actuator 45 is at the holding position R2, the contact portion 45*a*1 is generally parallel to the individual elevation cam receiving portion 42*g*. Therefore, the contact portion 45*a*1 generally receives only an upward force from the roller holder 42. Thus, the actuator 45 is not easily shifted from the holding position R2, and the pinch roller 41 is stably held at the individual up position Pi. In this preferred embodiment, as shown in FIG. 10, the distance between the individual elevation cam receiving portion 42*g* and the swing shaft insertion portion 42*d* (the swing shaft 43) is set to be longer than the distance between the spring engaging portion 42*f* and the swing shaft insertion portion 42*d* (the swing shaft 43). Therefore, the pinch roller 41 may be elevated up by a small force based on the principle of leverage. After this, the pinch roller 41 may be elevated down individually by returning the actuator 45 to the separated position R1.

The overall elevation mechanism 60 may globally release the pinch rollers 41 individually held in this manner. As described above, when the pinch roller lever 63 is elevated up to rotate the plurality of global elevation cams 61, all the pinch rollers 41 are elevated up. Referring to FIG. 10, "Pt" is the position of the pinch roller 41 elevated up by the overall elevation mechanism 60. Hereinafter, the position of the pinch roller 41 in this state will be referred to also as a "global up position Pt". In this preferred embodiment, as shown in FIG. 10, the global up position Pt is above the individual up position Pi. Referring to FIG. 10, "P3" is the position of the individual elevation cam receiving portion 42*g* in the state where the pinch roller 41 is at the global up position Pt (hereinafter, P3 will be referred to as a "third position"). The third position P3 is below the second position P2. Therefore, when the pinch roller 41 is moved to the global up position Pt by the overall elevation mechanism 60, the actuator 45 and the roller holder 42 are separated from each other. When the pinch roller lever 63 is operated to press the overall swing member (the global elevation cam 61 in this preferred embodiment) to the global elevation cam receiving portion 42*e*, the roller holder 42 is separated from the actuator 45 at the holding position R2 (more specifically, separated from the contact portion 45*a*1 in the state where the actuator 45 is at the holding position R2).

When the contact portion 45*a*1 is separated from the roller holder 42, the actuator 45 returns from the holding position R2 to the separated position R1 by its own weight. As shown in FIG. 14, in the state where the actuator 45 is at the holding position R2, the lever 45*b* of the actuator 45 is to the right of the cam 45*a* and is held generally horizontal. When being separated from the roller holder 42 from this state, the actuator 45 rotates counterclockwise (direction opposite to the direction of arrow A) as seen in the rear view. As a result, the actuator 45 moves to the separated position R1. Therefore, the individual pinch roller 41 is released from the state of being held individually by the actuator 45.

As described above, the overall elevation mechanism 60 holds all the pinch rollers 41 at the global up position Pt, and as a result, releases the pinch rollers 41 individually held by the actuators 45. All the pinch rollers 41 are released from the individual held state and are held at the global up position Pt by the overall elevation mechanism 60.

[How to Use the Stopper]

In this preferred embodiment, the stopper 46 may be attached to the stopper attachment portion 13*b* to keep the pinch rollers 41 in the individually held state. By using the stopper(s) 46, for example, one or more pitch roller(s) 41 that is desired to be kept separated from the medium 5 may be kept separated from the medium 5 with no need for the user to operate the actuator 45 each time.

The stopper 46 is used as follows. First, the actuator 45 is located at the holding position R2. Then, the stopper 46 is attached to the stopper attachment portion 13*b*. When being attached in this manner, as shown in FIG. 14, the stopper 46 is located below the lever 45*b* in the state where the actuator 45 is at the holding position R2. Therefore, the stopper 46 inhibits the actuator 45 from moving to the separated position R1. As a result, the pinch roller 41 is kept in the individually held state. In the case where the pinch roller 41 does not need to be kept in the individually held state, the user may detach the stopper 46 to release the pinch roller 41 from the individually held state. The stopper 46 does not need to keep the actuator 45 at the holding position R2. The stopper 46 is merely required to inhibit the actuator 45 from moving to the separated position R1. It is sufficient that the pinch roller 41 is separated from the grit roller 21 in the state where the stopper 46 is attached to the stopper attachment portion 13*b* and the actuator 45 is inhibited by the stopper 46 from moving.

[Functions and Effects of this Preferred Embodiment]

Hereinafter, functions and effects provided by the printer 10 according to this preferred embodiment will be described.

[Functions and Effects of the Pinch Rail Divided into the Plurality of Short Rails]

First, functions and effects of the pinch rail 30 divided into the plurality of short rails 30A and 30B will be described. Conventionally, a member to be engaged with a pinch roller such that the pinch roller is movable in the main scanning direction (such a member will be referred to as an "engaged member") is not divided, unlike in this preferred embodiment, but is formed as one component. The engaged member is formed by, for example, cutting or shaving a metal member. In order to allow the pinch roller to slide smoothly, it is preferred that the engaged member is formed to be as straight as possible. Therefore, the engaged member is formed to have a high rigidity and a high size precision. To achieve this aim, the engaged member is, for example, formed of a highly strong metal material or formed to be thick, and is formed with a high size precision. This causes the engaged member to cost high. This tendency is more conspicuous for an engaged member longer in the main scanning direction Y.

By contrast, in this preferred embodiment, the pinch rail 30 is divided into the plurality of short rails 30A and 30B located in a line in the main scanning direction Y. The plurality of short rails 30A and 30B are each shorter than the pinch rail 30 in the main scanning direction Y. Therefore, even if not being as rigid as a pinch roller formed as one component, the short rails 30A and 30B are warped less. Even if not being processed with a high precision, the short rails 30A and 30B having a short length in the main scanning direction Y have a small size error, if having any size error. For these reasons, the pinch rail 30 may cost less. As a result, the printer 10 may cost less.

In this preferred embodiment, the plurality of short rails 30A and 30B are formed of a resin by molding. Each of the short rails 30A and 30B is not required to have a high rigidity or a high size precision, and therefore, is allowed to be formed of, for example, a resin. This may significantly decrease the cost of the pinch rail 30 as compared with the case where, for example, the pinch rail 30 is formed by shaving a stainless steel member. In the case where the plurality of short rails 30A and 30B are formed of aluminum by die-casting, the cost may be decreased for a similar reason.

In this preferred embodiment, the plurality of short rails 30A and 30B include a plurality of (or one) first short rails 30A and a plurality of (or one) second short rails 30B different in length in the main scanning direction Y from the first short rails 30A. Since a plurality of types of short rails 30A and 30B having different lengths in the main scanning direction are prepared, these short rails may be assembled in a manner suitable for a printer having any of various lengths in the main scanning direction Y. In addition, printers having various lengths in the main scanning direction Y may use common short rails as components.

In this preferred embodiment, the guide rail 91 in engagement with the print head 70 and the cutting head 80 has a surface facing the platen 11 (in this preferred embodiment, the bottom surface 91*a*), and the positioning surfaces 34A1 and 34B1 of the plurality of short rails 30A and 30B are in contact with the bottom surface 91*a* of the guide rail 91. As described above, this structure determines the position of the pinch rail 30 in the up-down direction Z more accurately. Such a higher accuracy allows forces of the plurality of pinch rollers 41 pressing the medium 5 to be varied less. In this preferred embodiment, the pinch rail 30 is divided into the plurality of short rails 30A and 30B, and therefore, is abutted against the guide rail 91 more accurately and more easily. If the pinch rail is not divided into a plurality of short rails, it may be possible that the pinch rail is not abutted against the guide rail accurately because of, for example, a strain or the like of the pinch rail. The work of abutting the pinch rail against the guide rail is difficult because the pinch rail is long. By contrast, in this preferred embodiment, the short rails 30A and 30B are each short in the main scanning direction Y. Therefore, the short rails 30A and 30B each have a small strain, if having any strain, and thus the pinch rail 30 may be abutted against the guide rail 91 accurately. The work of abutting is easy. The pinch rail 30 divided into the plurality of short rails 30A and 30B may also be abutted against the front panel 12 more accurately and more easily.

In this preferred embodiment, the short rails 30A each include the plurality of protrusion portions 34A protruding upward as compared with the rest thereof. The positioning surfaces 34A1 as the top surfaces of the plurality of protrusion portions 34A form a discontinuous top surface of each short rail 30A. Such a structure may improve the position precision of the positioning surfaces 34A1 with respect to the engaged portions 32A. If, for example, the first short rail 30A has a continuous top surface, such a top surface is long in the main scanning direction Y. In this preferred embodiment, the first short rail 30A is formed of a resin by molding. Therefore, the position of such a top surface of the first short rail 30A long in the main scanning direction Y is easily varied in the up-down direction Z with respect to the engaged portions 32A. By contrast, in this preferred embodiment, the plurality of protrusions 34A protruding upward have the positioning surfaces 34A1, which are shorter in the main scanning direction Y. This allows the positions of the positioning surfaces 34A1 in the up-down direction Z to be varied less with respect to the engaged portions 32A. This is also applicable to the second short rails 30B. The precision in the distance between the engaged portions 32A and the positioning surfaces 34A1, and the precision in the distance between the engaged portions 32B and the positioning surfaces 34B1, are improved, and as a result, the positions of the plurality of engaged portions 32A and 32B in the up-down direction Z are made more uniform. This makes the entirety of the engaged portion 32 more straight, and thus the pinch roller unit 40 is made movable more smoothly along the pinch rail 30. The precision of the position of the pinch roller 41 in the up-down direction Z with respect to the platen 11 is also improved.

In this preferred embodiment, the engaged portions 32A of the first short rails 30A and the engaged portions 32B of the second short rails 30B protrude outward in the main scanning direction Y as compared with the rest of the short rails 30A and the second short rails 30B. Such a structure allows the engaged portions 32A and the engaged portions 32B to contact each other in a state where the first short rails 30A and the second short rails 30B are located in a line in the main scanning direction Y. As a result, the engaged portion 32 may be continuous with no gap. If, for example, in the state where the first short rails 30A and the second short rails 30B are located in a line in the main scanning direction Y, the flat portions 31A and 31B are in contact with each other whereas the engaged portions 32A and 32B are not in contact with each other, the engaged portion 32 is not continuous. In such a state, the pinch roller unit 40 may possibly be inhibited from sliding smoothly. In this preferred embodiment, the engaged portions 32A and 32B are protruded from the rest of the first short rails 30A and the second short rails 30B outward in the main scanning direction Y to prevent such a problem.

In this preferred embodiment, as described above, the first short rails 30A and the second short rails 30B are secured to the front panel 12 after being set so as to be warped to protrude in a direction opposite to the direction toward the front panel 12. Therefore, the warp of the first short rails 30A and the second short rails 30B is corrected. Such a correction of the warp is made possible because the rigidity of the first short rails 30A and the second short rails 30B is not very high.

[Functions and Effects of the Pinch Roller Units Capable of Individually Elevating the Pinch Rollers Up or Down]

Now, functions and effects of the pinch roller units 40 capable of individually elevating the pinch rollers 41 up or down will be described. As described above, in this preferred embodiment, each pinch roller unit 40 includes the actuator 45 capable of distancing the pinch roller 41 individually from the grit roller 21. Therefore, in the case where, for example, a part of the medium 5 is floated from the platen 11, the pinch roller 41 provided in a region where the floating part of the medium 5 is to pass may be elevated up. As a result, a problem that, for example, the medium 5 is stuck with the pinch roller 41 to cause a jam may be avoided. In the meantime, the printer 10 as a whole may keep pressing the medium 5. The float of the medium 5 is often solved by separating the pinch roller 41, provided in the vicinity of the floating part of the medium 5, from the medium 5. When this occurs, after the float is solved, the pinch roller 41 separated from the medium 5 may be put into contact with the medium 5 again.

A situation where the pinch roller 41 needs to be elevated up or down individually as described above often occurs during printing or cutting. The print head 70 and the cutting head 80 are provided downstream, namely, on the X1 side, with respect to the plurality of pinch roller units 40, and are driven to run during printing or cutting. Therefore, it is basically impossible to perform the work of operating the pinch roller 41 on the downstream side in the sub scanning direction X, namely, on the X1 side. It is highly possible that a temporary pause in printing or cutting influences the printing quality or the cutting quality. If printing is temporarily paused, for example, the printing state may be undesirably changed after the pause. If cutting is temporarily paused, for example, ink may soak into the medium 5 to change the size of the medium 5, and as a result, the cutting position or the positional relationship between the cutting position and the printing position may be undesirably shifted after the pause. If printing or cutting is stopped for a certain time period, the productivity of the printing or the cutting is decreased.

In this preferred embodiment, the actuator 45 is provided upstream in the sub scanning direction X, namely, on the X2 side, with respect to the pinch roller 41, and thus is operable by the user. Such a structure allows the user to operate to individually elevate the pinch roller 41 up or down on the upstream side in the sub scanning direction X, namely, on the X2 side. Therefore, the pinch roller 41 may be individually elevated up or down without stopping the printing or the cutting. The printer 10 according to this preferred embodiment allows the plurality of pinch rollers 41 to be elevated up or down individually at a desired timing even during the printing or the cutting.

In this preferred embodiment, the pinch roller units 40 each include the roller holder 42 swinging while supporting the pinch roller 41 to cause the pinch roller 41 to contact, or to be spaced from, the grit roller 21. The actuator 45 contacts, or is separated from, the roller holder 42 to swing the roller holder 42, and thus moves the pinch roller 41 in the up-down direction Z. More specifically, the actuator 45 includes the cam 45*a* and the lever 45*b* connected with the cam 45*a* and capable of rotating the cam 45*a*. The cam 45*a* includes the contact portion 45*a*1 contacting, or separated from, the roller holder 42 in accordance with the position thereof in the rotation direction. Such a structure allows the user to move the pinch roller 41 by a simple operation of grasping the lever 45*b* to rotate the cam 45*a*.

In this preferred embodiment, the printer 10 further includes the overall elevation mechanism 60 causing all the pinch rollers 41 to contact, or to be spaced from, the grit rollers 21 and capable of keeping all the pinch rollers 41 spaced from the grit rollers 21. In this preferred embodiment, all the pinch rollers 41 held individually by the actuator 45 are released from such a held state by the overall elevation mechanism 60 holding all the pinch rollers 41. With such a structure, an operation made on the overall elevation mechanism 60 may globally release the pinch rollers 41 from the individually held state. Therefore, the work of releasing the pinch rollers 41 from the held state is simplified. A situation where the user forgets to release the pinch rollers 41 from the held state is prevented.

This will be described more specifically. In this preferred embodiment, the pinch roller lever 63 is operated to put the global elevation cam 61 into contact with the roller holder 42, and the roller holder 42 is held by the global elevation cam 61. When this occurs, the roller holder 42 is separated from actuator 45 located at the holding position R2. In this preferred embodiment, when being held by the global elevation cam 61, the roller holder 42 is moved to a position below the actuator 45 located at the holding position R2. When being separated from the roller holder 42, the actuator 45 moves from the holding position R2 to the separated position R1. As a result, the pinch roller 41 is released from the state of being held individually by the actuator 45. Such a structure does not require a special member that couples the overall elevation mechanism 60 and each of the actuators 45. Therefore, the pinch rollers 41 may be globally released from individually held state in a simple manner.

In order to release the pinch roller 41 as described above, the actuator 45 moves from the holding position R2 to the separated position R1 by its own weight. Such a structure allows all the pinch rollers 41 to be released from the held state more simply. Alternatively, the actuator 45 does not need to use its own weight to move from the holding position R2 to the separated position R1 after being separated from the roller holder 42. For example, the actuator 45 may move from the holding position R2 to the separated position R1 by a force of an elastic body such as a spring or the like after being separated from the roller holder 42.

The printer 10 according to this preferred embodiment includes the stopper 46 and the stopper attachment portion 13*b*. The stopper 46 inhibits the actuator 45 from moving to the separated position R1. The stopper 46 is attachable to, or detachable from, the stopper attachment portion 13*b*. In a state where the stopper 46 is attached to the stopper attachment portion 13*b* and inhibits the actuator 45 from moving, the pinch rollers 41 are separated from the grit rollers 21. With such a structure, the stopper 46 may be attached to the stopper attachment portion 13*b* to keep the pinch rollers 41 separated from the grit rollers 21 individually. By this, for example, the pinch roller 41 that is desired to be kept separated from the medium 5 may be kept separated from the medium 5 with no need for the user to operate the actuator 45 each time. In the case where the pinch roller 41 does not need to be kept separated from the medium 5 any more, the stopper 46 may be detached from the stopper attachment portion 13*b* to release the pinch roller 41 from the held state.

Other Preferred Embodiments

One preferred embodiment is described above. The above-described preferred embodiment is merely an example, and the technology disclosed herein may be carried out in various other forms.

For example, in the above-described preferred embodiment, the plurality of short rails 30A and 30B are each like a flat plate. There is no specific limitation on the shape of the short rails or the shape of the pinch rail as an assembly of the short rails. The short rails or the pinch rail may have, for example, a prism shape or a cylindrical shape. The short rails do not need to be positioned by being abutted against the guide rail engaged with the carriages, or do not need to be secured to the front panel. There is no specific limitation on the method for positioning the short rails or the method for securing the short rails.

In the above-described preferred embodiment, the plurality of first short rails 30A and the plurality of second short rails 30B are provided. Alternatively, one first short rail 30A or one second short rail 30B may be provided. No first short rail 30A may be provided, or no second short rail 30B may be provided. One short rail 30A and one second short rail 30B may be provided. The pinch rail 30 merely needs to include a plurality of short rails 30A and/or 30B located in a line in the main scanning direction Y. For example, the pinch rail 30 may include one type of short rails 30A or 30B located in a line in the main scanning direction Y.

In the above-described preferred embodiment, the plurality of short rails 30A and 30B are located to be in contact with each other in the main scanning direction Y, and the pinch rail 30 is continuous in the main scanning direction Y. Alternatively, the pinch rail may extend intermittently in the main scanning direction Y. The pinch rail merely needs to include a plurality of short rails located in a line in the main scanning direction Y, and does not need to be continuous. The "pinch rail extending in the main scanning direction" encompasses a pinch rail including a plurality of short rails located in a line continuously in the main scanning direction, and a pinch rail including a plurality of short rails located in a line intermittently in the main scanning direction. For example, it is permissible that the pinch rail is provided intermittently in regions where the pinch roller units need to slide but is not provided in any other region. In the case where the user does not need to move the pinch roller units, the pinch rail may be provided intermittently and may be used only to adjust the positions of the pinch roller units during the production of the printer.

The medium transportation device transporting the medium may include, for example, a support table supporting the medium and a transportation device transporting the medium supported by the support table in a predetermined transportation direction. The transportation device may include a first rail, a second rail, a first pinch roller unit, a second pinch roller unit, and a driving roller provided on the support table and extending in a perpendicular direction perpendicular to the transportation direction. The driving roller rotates in the transportation direction. The first rail may be provided so as to face the support table and extend in the perpendicular direction. The second rail may be provided in a line with the first rail in the perpendicular direction, and may extend in the perpendicular direction. The first pinch roller unit may include a first pinch roller allowed to contact, or to be separated from, the driving roller, and may be in engagement with the first rail so as to be movable in the perpendicular direction along the first rail. The second pinch roller unit may include a second pinch roller allowed to contact, or to be separated from, the driving roller, and may be in engagement with the second rail so as to be movable in the perpendicular direction along the second rail. In the medium transportation device having such a structure, the first rail may be provided in a range in which the first pinch roller unit is slidable, and the second rail may be provided in a range in which the second pinch roller unit is slidable. There may be a gap between the first rail and the second rail. Therefore, the amount of the material used to form the rails may be saved as compared with the case where a long rail to be engaged with the first pinch roller unit and the second pinch roller unit is provided. The cost of producing the medium transportation device may also be decreased.

In the above-described preferred embodiment, the pinch roller 41 is elevated up or down by the cam 45*a* of the actuator 45. There is no specific limitation on the method for moving the pinch roller. The pinch roller may be moved up or down along, for example, a slide guide or the like. Alternatively, a wedge-like member may be inserted into, or pulled out of, a space between a member supporting the pinch roller and another member to move the pinch roller. In the above-described preferred embodiment, the pinch roller 41 is elevated up by a contact thereof with the actuator 45. Alternatively, the pinch roller 41 may be elevated down by a contact thereof with the actuator 45. For example, the pinch roller may be loaded upward by an elastic member and moved downward by a contact thereof with the actuator. In the above-described preferred embodiment, the roller holder 42 swings about the swing shaft 43 to move the pinch roller 41 in the up-down direction Z. Alternatively, the roller holder may move (e.g., slide) in the up-down direction Z to move the pinch roller in the up-down direction Z.

In the above-described preferred embodiment, the printer 10 includes the overall elevation mechanism 60 moving all the pinch rollers 41 of the plurality of pinch roller units 40 in the up-down direction Z. The printer 10 does not need to include the overall elevation mechanism 60. Even in the case of including the overall elevation mechanism 60, the printer does not need to have a structure by which an operation made on the overall elevation mechanism 60 releases all the pinch rollers from the individually held state. The printer may include another mechanism that globally releases the pinch rollers from the individually held state. The printer does not need to include any mechanism that globally releases the pinch rollers from the individually held state.

In the above-described preferred embodiment, the actuator 45 is provided only upstream in the sub scanning direction X, namely, on the X2 side, with respect to the print head 70, the cutting head 80 and the pinch roller 41. Alternatively, the pinch roller units may each include another actuator that is provided downstream in the sub scanning direction with respect to the pinch roller and is operable from the front of the printer.

The device according to the above-described preferred embodiment is a printer with a cutting head. The technology disclosed herein is applicable to any device other than the printer with a cutting head. The technology disclosed herein is applicable to, for example, a printer including a print head performing printing on a medium but not including a cutting head, a cutting device including a cutting head cutting a medium but not including a print head, or the like. Even in the case where the technology disclosed herein is applied to a printer with a cutting head, the structure of the printer with a cutting head is not limited to the one shown in the above-described preferred embodiment. The technology disclosed herein is applicable to, for example, a medium transportation device not including a head that processes a medium such as a print head, a cutting head or the like.

The preferred embodiments described herein do not limit the present invention unless otherwise specified. For example, the structure of the pinch roller unit and the structure of the overall elevation mechanism are merely examples, and do not limit the present invention in any way.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiment described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printer, comprising:

a support table to support a medium;

a driving roller provided on the support table to move the medium supported on the support table in a predetermined transportation direction;

a plurality of pinch roller assemblies facing the driving roller;

a print head provided downstream in the transportation direction with respect to the driving roller and the plurality of pinch roller assemblies and facing the support table; and a rear panel provided upstream in the transportation direction with respect to the plurality of pinch roller assemblies and including a surface exposed upstream in the transportation direction; wherein the plurality of pinch roller assemblies each include:

a pinch roller facing the driving roller;

a support to support the pinch roller to allow the pinch roller to contact, or to be spaced from, the driving roller; and an actuator including a contact portion contactable with the support, and an operation portion that is operated by a user to press the contact portion to the support to move the pinch roller in a direction away from the driving roller;

the actuator is provided upstream in the transportation direction with respect to the pinch roller; and the operation portion is provided on the surface exposed upstream in the transportation direction of the rear panel.

2. The printer according to claim 1, further comprising an overall moving device to cause all the pinch rollers in all the plurality of pinch roller assemblies to contact, or to be spaced from, the driving roller, and holding all the pinch rollers spaced from the driving roller; wherein the actuator of each of the plurality of pinch roller assemblies is capable of individually holding the corresponding pinch roller spaced from the driving roller; and by holding all the pinch rollers, the overall moving device is capable of releasing, at a same time, all the pinch rollers states of being held by the corresponding actuators.

3. The printer according to claim 2, wherein the support is swingable while supporting the pinch roller to cause the pinch roller to contact, or to be spaced from, the driving roller;

the actuator is movable, in accordance with an operation made on the operation portion, between a holding position at which the contact portion presses the support and a separated position at which the contact portion is separated from the support;

the overall moving device includes:

an overall swing to swing all the supports, and to press all the supports to hold all the pinch rollers; and an overall operation portion connected with the overall swing to operate the overall swing;

the support, when being pressed by the overall swing by an operation made on the overall operation portion in a state where the support is in contact with the contact portion, is separated from the contact portion; and the actuator is movable from the holding position to the separated position upon the separation of the contact portion from the support.

4. The printer according to claim 3, wherein the actuator is movable from the holding position to the separated position by a self weight thereof.

5. The printer according to claim 3, further comprising:

a stopper to inhibit the actuator from moving to the separated position; and a stopper attachment portion to allow the stopper to be attached thereto or to be detached therefrom; wherein the pinch rollers are each separated from the driving roller in a state where the stopper is attached to the stopper attachment portion and the actuator is inhibited by the stopper from moving.

6. The printer according to claim 1, wherein the operation portion includes:

a rotation shaft that is provided with the rear panel; and a handle that is rotatable about the rotation shaft and moves the contact portion to contact with the support or to separate from the support.

7. The printer according to claim 6, wherein the operation portion includes an eccentric cam rotatable about the rotation shaft and including an outer circumferential surface, different positions on which have different distances from the rotation shaft;

wherein the eccentric cam includes the contact portion at the outer circumferential surface and is connected with the handle.

8. A cutting device, comprising:

a support table to support a medium;

a driving roller provided on the support table to move the medium supported on the support table in a predetermined transportation direction;

a plurality of pinch roller assemblies facing the driving roller;

a cutting head provided downstream in the transportation direction with respect to the driving roller and the plurality of pinch roller assemblies and facing the support table; and a rear panel provided upstream in the transportation direction with respect to the plurality of pinch roller assemblies and including a surface exposed upstream in the transportation direction; wherein the plurality of pinch roller assemblies each include:

a pinch roller facing the driving roller;

a support to support the pinch roller to allow the pinch roller to contact, or to be spaced from, the driving roller; and an actuator including a contact portion contactable with the support, and an operation portion that is operated by a user to press the contact portion to the support to move the pinch roller in a direction away from the driving roller;

the actuator is provided upstream in the transportation direction with respect to the pinch roller; and the operation portion is provided on the surface exposed upstream in the transportation direction of the rear panel.

9. The cutting device according to claim 8, further comprising an overall moving device to cause all the pinch rollers in all the plurality of pinch roller assemblies to contact, or to be spaced from, the driving roller, and holding all the pinch rollers spaced from the driving roller, wherein the actuator of each of the plurality of pinch roller assemblies is capable of individually holding the corresponding pinch roller spaced from the driving roller; and by holding all the pinch rollers, the overall moving device is capable of releasing, at a same time, all the pinch rollers states of being held by the corresponding actuators.

10. The cutting device according to claim 9, wherein the support is swingable while supporting the pinch roller to cause the pinch roller to contact, or to be spaced from, the driving roller;

the actuator is movable, in accordance with an operation made on the operation portion, between a holding position at which the contact portion presses the support and a separated position at which the contact portion is separated from the support;

the overall moving device includes:

an overall swing to contact or be separated from, all the supports in all the plurality of pinch roller assemblies to swing all the supports, and to press all the supports to hold all the pinch rollers; and an overall operation portion connected with the overall swing to operate the overall swing;

the support, when being pressed by the overall swing by an operation made on the overall operation portion in a state where the support is in contact with the contact portion, is separated from the contact portion; and the actuator is movable from the holding position to the separated position upon the separation of the contact portion from the support.

11. The cutting device according to claim 10, wherein the actuator is movable from the holding position to the separated position by a self weight thereof.

12. The cutting device according to claim 10, further comprising:

a stopper to inhibit the actuator from moving to the separated position; and a stopper attachment portion to allow the stopper to be attached thereto or to be detached therefrom; wherein the pinch rollers are each separated from the driving roller in a state where the stopper is attached to the stopper attachment portion and the actuator is inhibited by the stopper from moving.

13. The cutting device according to claim 8, wherein the operation portion includes:

a rotation shaft that is provided with the rear panel; and a handle that is rotatable about the rotation shaft and moves the contact portion to contact with the support or to separate from the support.

14. The cutting device according to claim 13, wherein the operation portion includes an eccentric cam rotatable about the rotation shaft and including an outer circumferential surface, different positions on which have different distances from the rotation shaft;

wherein the eccentric cam includes the contact portion at the outer circumferential surface and is connected with the handle.

* * * * *